US008986548B2

(12) United States Patent
Zung

(10) Patent No.: US 8,986,548 B2
(45) Date of Patent: Mar. 24, 2015

(54) OIL CONTAINMENT RECOVERY DOME

(76) Inventor: Thomas T. K. Zung, Bratenahl, OH (US)

( * ) Notice: Subject to any disclaimer, the term of this patent is extended or adjusted under 35 U.S.C. 154(b) by 357 days.

(21) Appl. No.: 13/486,304

(22) Filed: Jun. 1, 2012

(65) Prior Publication Data

US 2012/0305493 A1 Dec. 6, 2012

Related U.S. Application Data

(60) Provisional application No. 61/493,803, filed on Jun. 6, 2011, provisional application No. 61/512,725, filed on Jul. 28, 2011, provisional application No. 61/515,067, filed on Aug. 4, 2011.

(51) Int. Cl.

| | |
|---|---|
| ***E02B 15/06*** | (2006.01) |
| ***E21B 43/01*** | (2006.01) |
| *E02B 15/00* | (2006.01) |

(52) U.S. Cl.

CPC ..... *E21B 43/0122* (2013.01); *E02B 15/06* (2013.01); *E02B 2015/005* (2013.01); *Y10S 210/923* (2013.01)

USPC ..... 210/747.5; 210/170.11; 210/923; 405/60; 166/364

(58) Field of Classification Search

CPC E02B 15/06; E02B 2015/005; E21B 43/0122

USPC ..... 210/747.5, 747.6, 170.05, 170.09, 210/170.11, 242.1, 242.3, 923; 405/60, 64; 166/364

See application file for complete search history.

(56) References Cited

U.S. PATENT DOCUMENTS

| | | | | |
|---|---|---|---|---|
| 1,830,061 | A | | 11/1931 | Howe |
| 3,203,144 | A | | 8/1965 | Fuller |
| 3,322,141 | A | | 5/1967 | Gans, Jr. et al. |
| 3,389,559 | A | | 6/1968 | Logan |
| 3,548,605 | A | * | 12/1970 | Armistead et al. ..... 405/60 |
| 3,653,215 | A | | 4/1972 | Crucet |
| 3,658,181 | A | | 4/1972 | Blair |
| 3,664,136 | A | | 5/1972 | Lavel, Jr. et al. |
| 3,667,605 | A | * | 6/1972 | Zielinski ..... 210/170.11 |
| 3,710,582 | A | | 1/1973 | Hills et al. |
| 3,724,662 | A | * | 4/1973 | Ortiz ..... 210/242.3 |
| 3,879,951 | A | | 4/1975 | Mason |
| 3,981,154 | A | | 9/1976 | Hix |
| 4,047,390 | A | | 9/1977 | Boyce |

(Continued)

FOREIGN PATENT DOCUMENTS

| | | | |
|---|---|---|---|
| DE | 102011001987 | * | 10/2012 |
| WO | 2005/045308 A1 | | 5/2005 |

OTHER PUBLICATIONS

International Preliminary Report on Patentability (Chapter I of the Patent Cooperation Treaty (Dec. 27, 2013), USPTO.

(Continued)

*Primary Examiner* — Christopher Upton

(74) *Attorney, Agent, or Firm* — Dicke, Billig & Czaja, PLLC

(57) ABSTRACT

An oil containment recovery dome including an upper containment portion and at least one bladder. The upper containment portion has an enclosure defined therein that is adapted to receive equipment used in conjunction with a well and to retain therein oil or gas that escapes from the well. The at least one bladder is attached to the upper containment portion.

18 Claims, 30 Drawing Sheets

(56) References Cited

U.S. PATENT DOCUMENTS

| | | | | |
|---|---|---|---|---|
| 4,318,442 | A | 3/1982 | Lunde et al. | |
| 4,324,505 | A | 4/1982 | Hammett | |
| 4,358,218 | A | 11/1982 | Graham | |
| 4,405,258 | A | 9/1983 | O'Rourke et al. | |
| 4,449,850 | A * | 5/1984 | Cessou et al. | 405/60 |
| 4,456,071 | A | 6/1984 | Milgram | |
| 4,531,860 | A * | 7/1985 | Barnett | 405/60 |
| 4,643,612 | A * | 2/1987 | Bergeron | 405/60 |
| 5,050,680 | A | 9/1991 | Diehl et al. | |
| 5,213,444 | A | 5/1993 | Henning | |
| 5,259,458 | A | 11/1993 | Schaefer | |
| 5,325,642 | A | 7/1994 | Cooley | |
| 6,609,853 | B1 * | 8/2003 | Guilmette | 405/60 |
| 7,051,804 | B1 | 5/2006 | Arning | |
| 8,186,443 | B2 | 5/2012 | Wolinsky | |
| 8,196,665 | B2 | 6/2012 | Wolinsky | |
| 2005/0025574 | A1 * | 2/2005 | Lazes | 405/60 |
| 2006/0117675 | A1 | 6/2006 | Herrmann | |
| 2008/0209821 | A1 | 9/2008 | Nefzi | |
| 2010/0038324 | A1 | 2/2010 | Couch | |
| 2011/0274496 | A1 * | 11/2011 | Dvorak | 405/64 |
| 2012/0051841 | A1 * | 3/2012 | Hatton et al. | 405/63 |

OTHER PUBLICATIONS

International Search Report (PCT/US12/40694) dated Sep. 18, 2012—14 pages.

* cited by examiner 201
219
207
208, 209
202
200

219
201
207

207
201
202
200

208, 209
201
221

OIL CONTAINMENT RECOVERY DOME

REFERENCE TO RELATED APPLICATION

This application claims priority to U.S. Provisional Application No. 61/493,803, which was filed on Jun. 6, 2011; U.S. Provisional Application No. 61/512,725, which was filed on Jul. 28, 2011; and U.S. Provisional Application No. 61/515,067, which was filed on Aug. 4, 2011, the contents of each of which are incorporated herein by reference.

FIELD OF THE INVENTION

The invention relates generally, but not limited, to an oil recovery system. More particularly, the invention relates to an atmospheric, terrestrial, and/or oceanic structure that may be used for, but not limited to, oil containment and recovery. This invention may be used prior to the exploration of oil in oceans, thereby mitigating the spill at the onset.

BACKGROUND OF THE INVENTION

Crude oil is a popular source of energy for vehicles such as cars, trucks, motorcycles, and airplanes. There are various other uses for crude oil and products refined therefrom.

Typically, the crude oil is obtained from a well that is drilled beneath a surface of the ground. In addition to the wells being drilled into the ground on one of the continents, it has also been recognized that wells can be drilled into the ground located beneath bodies of water.

It is generally desired to collect substantially all of the crude oil that is extracted from a well to maximize the income generated from the well and to minimize the negative effects that are experienced when the oil escapes into the region surrounding the well.

While oil drilling technology enables drilling wells into very deep bodies of water such as having a depth of greater than about 5,000 feet, it becomes increasingly difficult to address issues that may develop at these depths. For example, it is generally not possible for humans to perform directly tasks at these depths. Rather, the immense pressures at these depths necessitate that the work be done using robotically controlled devices.

Even in situations where safety devices such as blowout preventers are utilized to address problems that may arise when drilling wells at these depths, it is possible that the safety devices may malfunction and that the crude oil may escape from the well and become intermixed with the body of water in which the well is located.

The presence of the crude oil in the water can be a health hazard to organisms that live in the body of water not only causing death to the organisms but also precluding the use of the organisms as a food source. The crude oil can also contaminate that shore that surrounds the body of water and thereby preclude the use of the shore for recreational activities.

In view of the hazards associated with crude oil escaping into a body of water, it is desirable to utilize a system that provides the ability to contain the crude oil that escapes during the drilling process such that the escaped crude oil may be recovered.

Most past efforts and equipment designed for these purposes were based upon the principle that you needed a large heavy mass (i.e., a 100-ton concrete dome) to capture the oil and withstand the pressure at more than 5,000 feet below sea level. It has also been attempted to utilize methods that work above sea level. However, such methods do not consistently work below sea level because of the pressures that exist at those depths.

SUMMARY OF THE INVENTION

An embodiment of the invention is directed to an oil containment recovery dome that includes an upper containment portion and at least one bladder. The upper containment portion has an enclosure defined therein that is adapted to receive equipment used in conjunction with a well and to retain therein oil or gas that escapes from the well. The at least one bladder is attached to the upper containment portion.

Another embodiment of the invention is directed to a method of containing and recovering oil or gas that leaks from a well that is located beneath a surface of a body of water. An oil containment recovery dome that includes an upper containment portion having enclosure defined therein that is adapted to receive equipment used in conjunction with a well and to retain therein oil or gas that escapes from the well. The oil containment recovery dome is transported to a location where a well is located. The oil containment recovery dome is moved into a position over the well.

Another embodiment of the invention is directed to an oil containment and recovery system that includes an oil containment recovery dome and a transport vehicle. The oil containment recovery dome includes an upper containment portion having enclosure defined therein that is adapted to receive equipment used in conjunction with a well and to retain therein oil or gas that escapes from the well. The transport vehicle is capable of moving the oil containment recovery dome to a location where the oil containment recovery dome is used.

BRIEF DESCRIPTION OF THE DRAWINGS

The accompanying drawings are included to provide a further understanding of embodiments, are incorporated in, and constitute a part of this specification. The drawings illustrate embodiments and together with the description serve to explain principles of embodiments. Other embodiments and many of the intended advantages of embodiments will be readily appreciated, as they become better understood by reference to the following detailed description. The elements of the drawings are not necessarily to scale relative to each other. Like reference numerals designate corresponding similar parts.

DETAILED DESCRIPTION OF THE PREFERRED EMBODIMENTS

An embodiment of the invention is directed to an oil containment recovery dome as illustrated at 100 in the figures. The oil containment recovery dome 100 is particularly suited for use in conjunction with an oil well that is to be drilled below a body of water.

In certain embodiments, the oil containment recovery dome 100 is used in conjunction with deep-water oil wells such as those drilled in water having depths of more than about 500 feet. In other embodiments, the oil wells are drilled in water at a depth of more than 5,000 feet.

In still other embodiments, it is possible to use the oil containment recovery dome 100 in conjunction with wells that are in relatively shallow water where it is especially desirable to minimize the potential of oil or gas escaping from the well into the water.

The oil containment recovery dome 100 is positioned on a ground surface beneath the body of water such that any oil or gas that escapes from the oil well is substantially contained within the oil containment recovery dome 100. Containing the oil within the oil containment recovery dome 100 facilitates recovering the oil and gas to minimize the potential of negative environmental impact from the oil.

Oil and gas that is contained within the oil containment recovery dome 100 may be directed to tankers that are positioned on the water surface proximate the oil containment recovery dome 100 such as using at least one conduit or feeder line.

Figure 1:
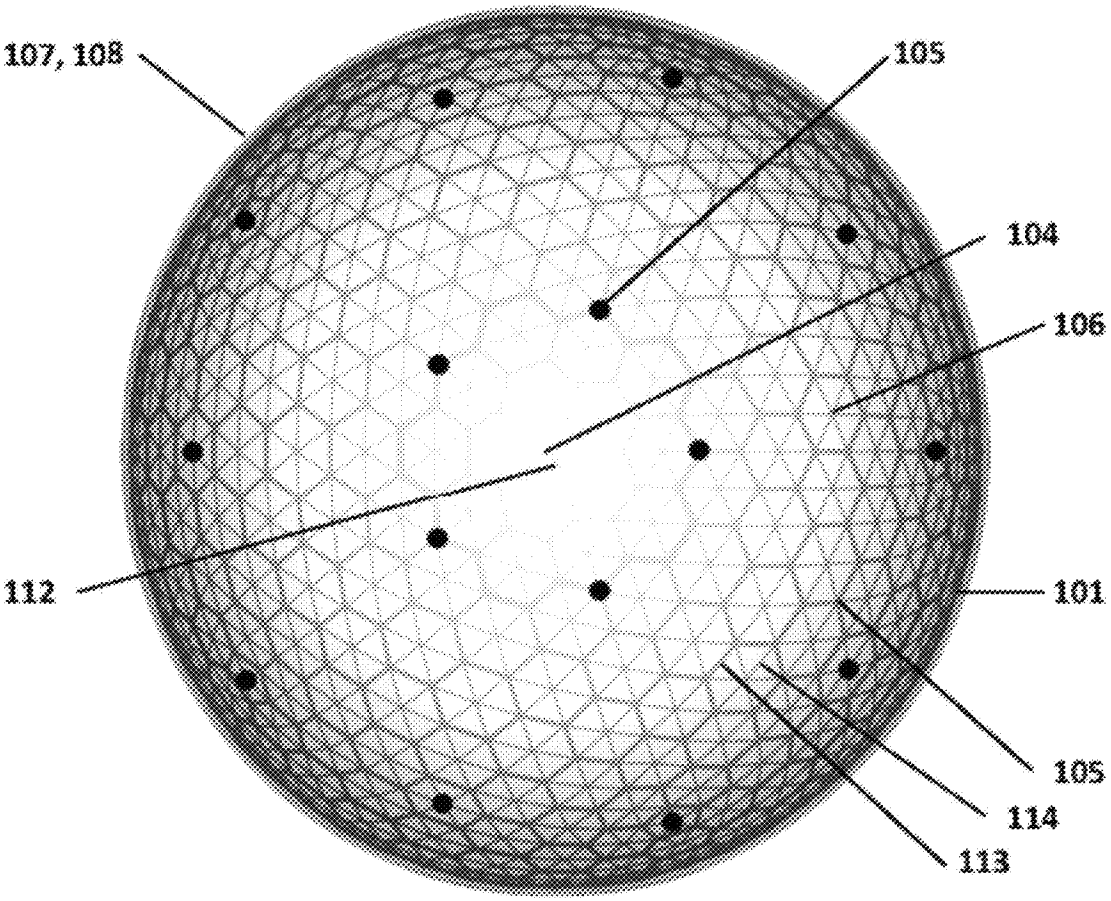
FIG. 1 is a plan view of an oil containment recovery dome according to an embodiment of the invention.
Figure 2:
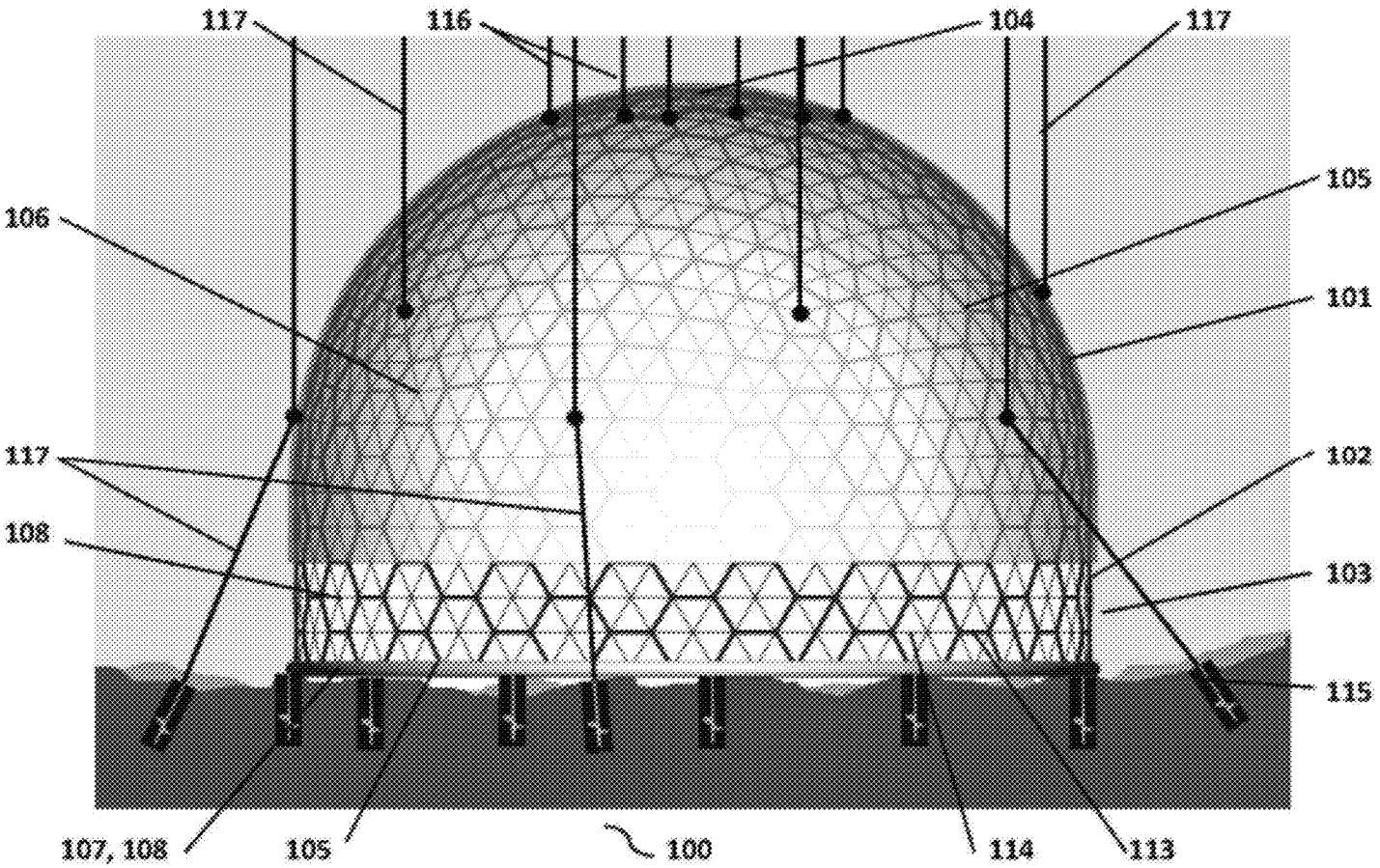
FIG. 2 is a profile view of the oil containment recovery dome of FIG. 1.
Figure 3:
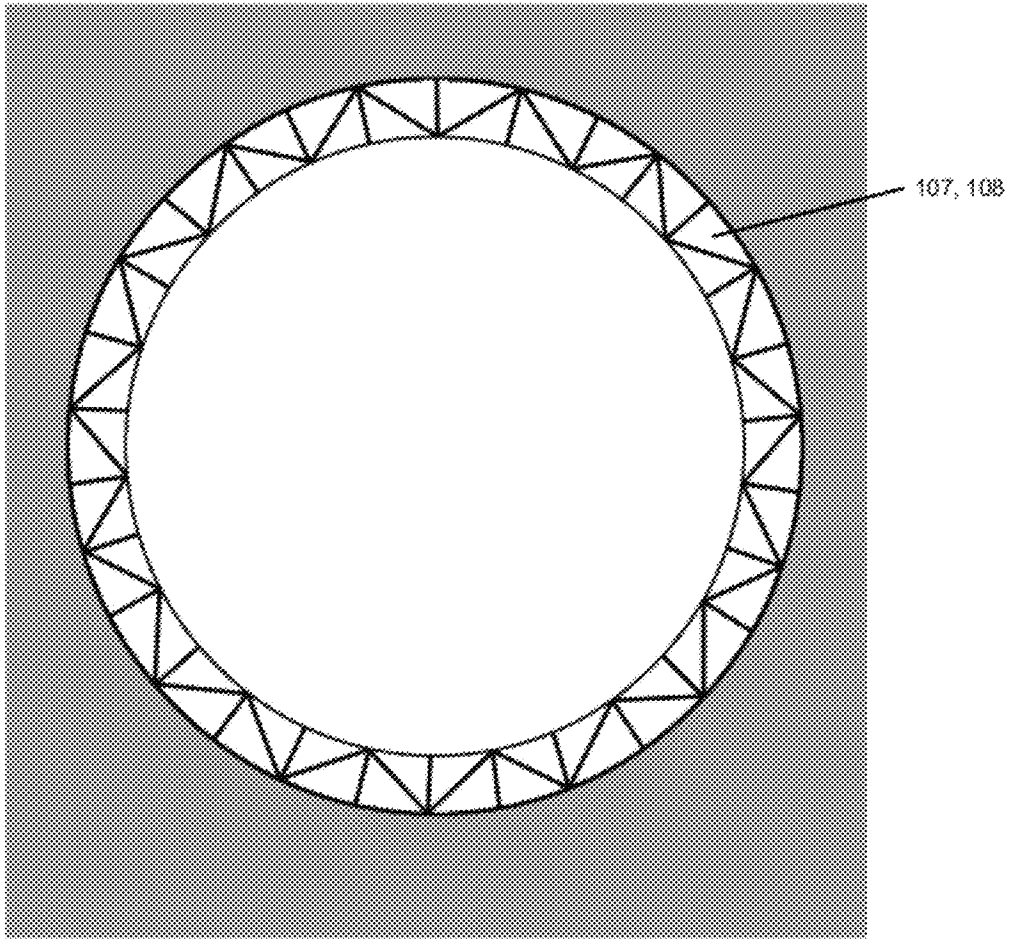
FIG. 3 is a plan view of a double resonated portion of the oil containment recovery dome of FIG. 1.

The oil containment recovery dome 100 should be formed with sufficient strength to withstand damage and/or movement. The oil containment recovery dome 100 may also have sufficient strength to withstand pressure developed within the oil containment recovery dome 100 caused by accumulation of oil there within. In certain embodiments, at least a portion of the oil containment recovery dome 100 has a geodesic shape, as illustrated in FIGS. 1 and 2.

Figure 27A:
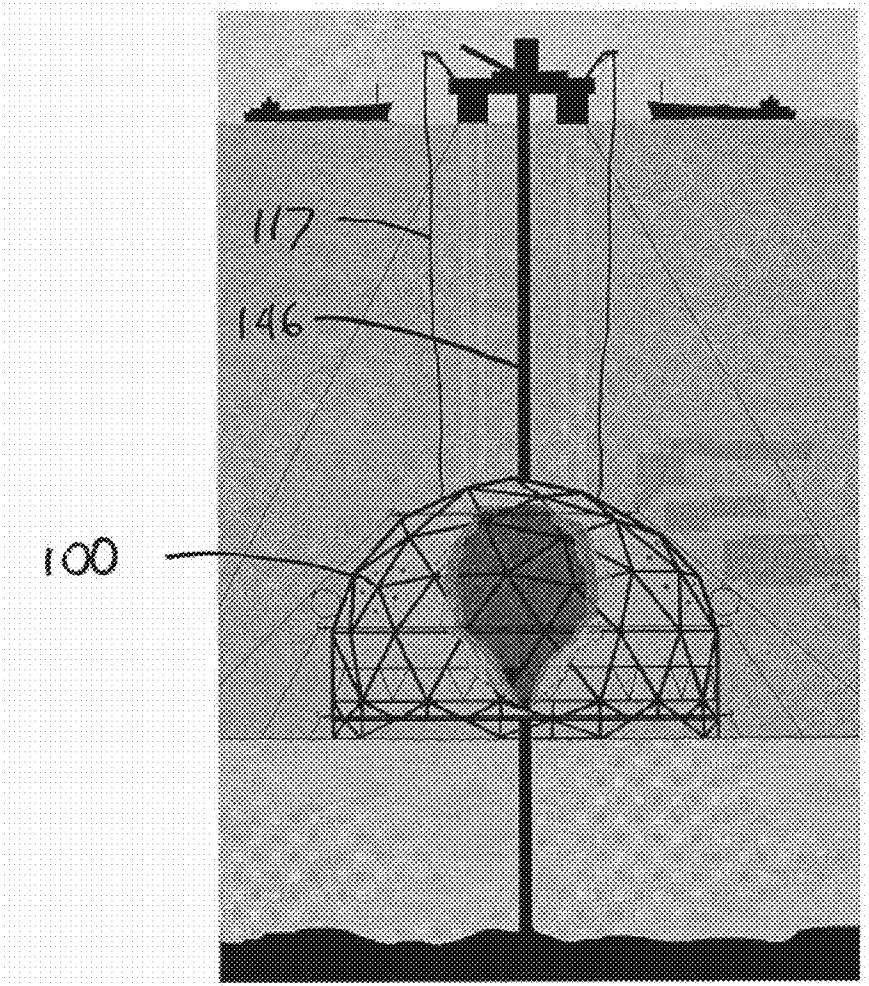
FIGS. 27*a* and 27*b* are side views of an oil leak contained within the oil containment recovery system.

The oil containment recovery dome 100 may be formed with a size that is sufficiently large to encompass not only the oil drilling equipment positioned on the ground surface of the body of water but also to encompass a large percentage of oil that could potentially leak from the oil well before such leaked oil could be recovered, as illustrated in FIG. 27*a*.

In certain embodiments, the oil containment recovery dome 100 has a diameter of between about 50 feet and about 300 feet. In other embodiments, the oil containment recovery dome 100 has a diameter of about 500 feet.

Figure 5:
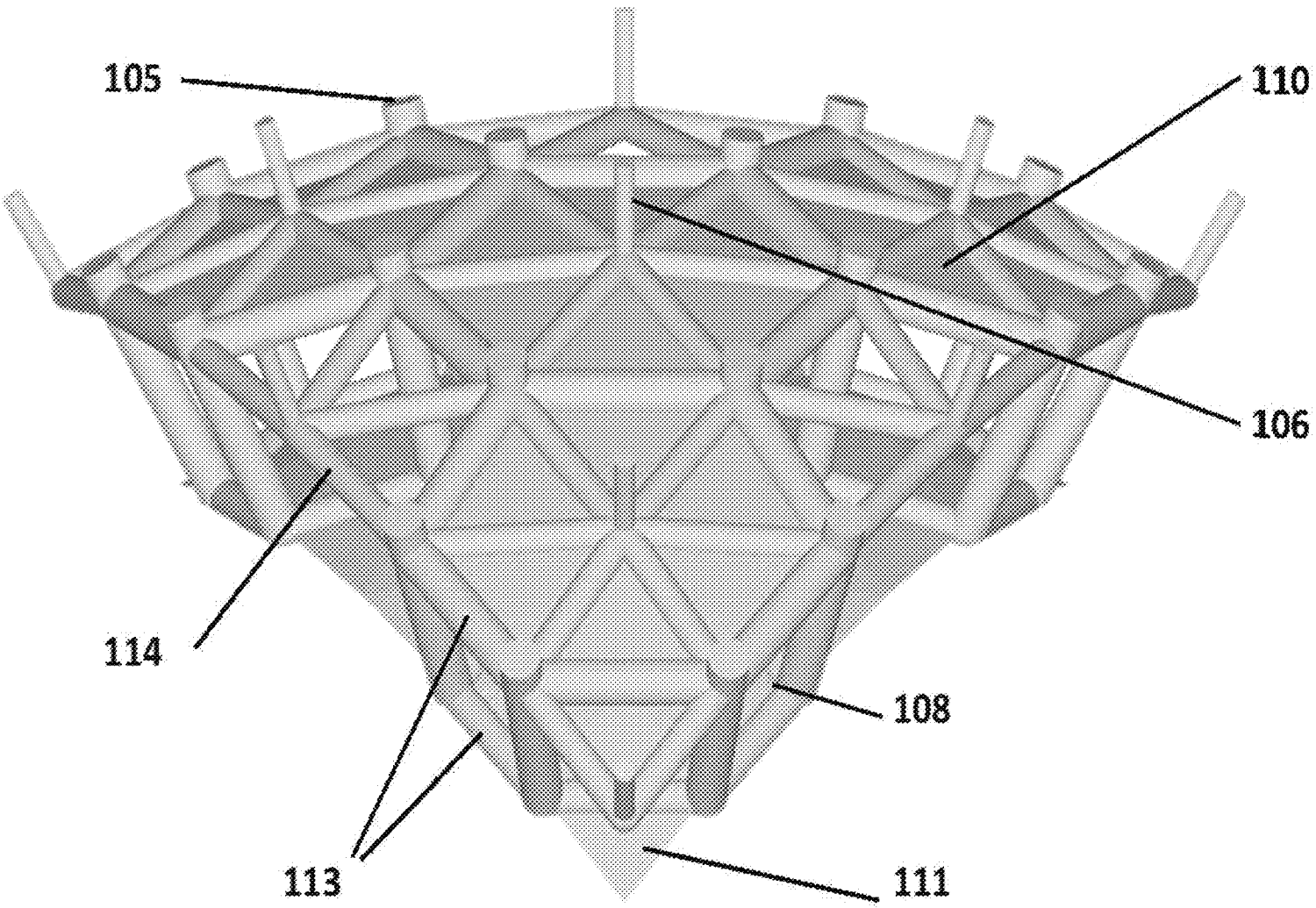
FIG. 5 is a perspective view of a portion of the double resonated dome structure showing connectors and other elements of FIG. 4.
Figure 7:
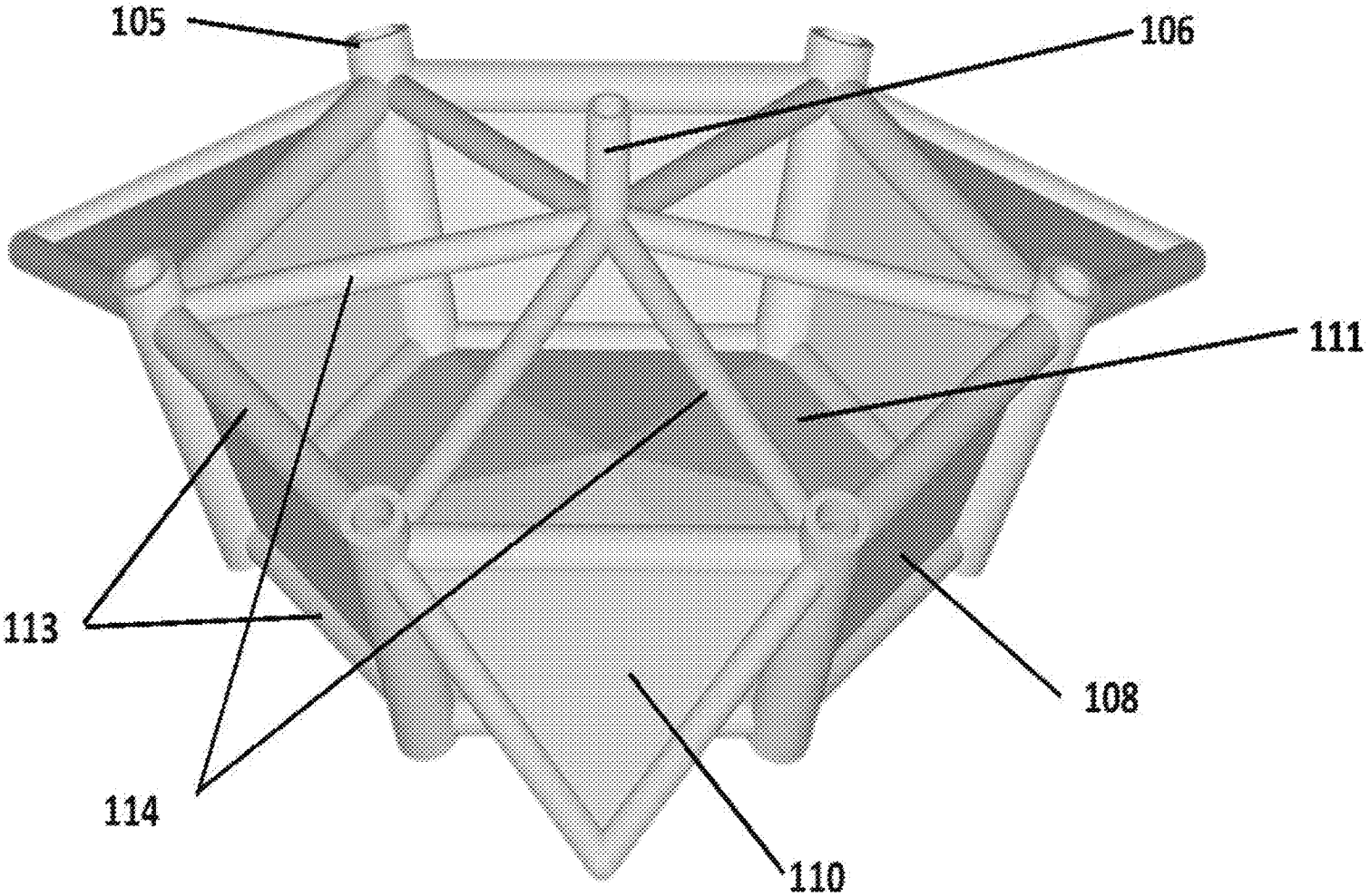
FIG. 7 is a perspective view of the double resonated dome structure to contain the buoyancy/ballast tank of the oil containment recovery dome of FIG. 1.

The oil containment recovery dome 100 may generally include an upper spherical section 101 and a lower cylinder section 102. The upper spherical section 101 may have a generally geodesic shape, as illustrated in FIGS. 1 and 2. The upper spherical section 101 and lower cylinder section 102 may be formed from a plurality of the first structural beams 113 and the second structural beams 114 that are attached together using first attachment assemblies 105 and second attachment assemblies 106, as illustrated in FIGS. 5 and 7.

An outer dome section has a diameter that is slightly larger than an inner dome section diameter, as illustrated in FIGS. 3, 4, 5 and 7. This dome configuration has been referred to as a double resonated dome.

An advantage of using this configuration is that a force placed on the outer dome section is distributed to the inner dome section. This process increases the strength of the oil containment recovery dome 100 to thereby minimize the potential that the force results in damage to the oil containment recovery dome 100.

In one such configuration, the inner dome section has structural elements that are arranged in a hexagonal configuration and the outer dome section has structural elements that are arranged in a triangular configuration.

As is discussed in more detail herein, the outer dome section may include two types of structural elements. The first structural elements may be arranged in a hexagonal configuration. The second structural elements may be arranged to define six triangles within each of the hexagons defined by the first structural elements.

While it is illustrated that the first structural elements are wider than the second structural elements, it is possible for other configurations to be used. An example of one such alternative configuration is where the first structural elements and the second structural elements are formed with a substantially similar width.

In certain embodiments, the first structural beam 113 and the second structural beam 114 are attached together in a generally triangular configuration and, the first structural beam 113 are attached together in a generally hexagonal and or polygonal configuration. In certain embodiments, at least portions of the triangles are acute triangles, equilateral triangles, and isosceles triangles, as illustrated in FIG. 5.

The first structural beam 113 and the second structural beam 114 may be fabricated from a variety of materials using the concepts of the invention. The first structural beam 113 and the second structural beam 114 should resist degradation when exposed to the conditions under which the oil containment recovery dome 100 is intended to be used. For example, if the oil containment recovery dome 100 is intended to be used in an ocean, the first structural beam 113 and the second structural beam 114 should resist degradation caused by salt and organisms that are conventionally present in ocean water.

In certain embodiments, the first structural members beam 113 and the second structural beam 114 may be fabricated from a metallic or polymeric material. It may be desirable to fabricate the first structural beam 113 and the second structural beam 114 from materials that have a relatively high strength as well as being relatively lightweight. Forming the structural members from materials having these characteristics enhances the ability to move the oil containment recovery dome 100 even if the oil containment recovery dome 100 has a relatively large diameter and/or height.

Examples of such suitable materials include steel containing additives that reduce the degradation of the steel when the steel is exposed to the salt and organisms conventionally found in ocean water. In certain embodiments, the first structural beam 113 and the second structural beam 114 are fabricated from stainless steel, titanium, magnesium and fiberglass or fiber composites.

The first structural beam 113 and the second structural beam 114 should have sufficient strength to resist deformation based upon the conditions under which the oil containment recovery dome 100 is intended to be used. Factors potentially affecting such strength include the diameter of the oil containment recovery dome 100 and the length of the structural members 113 and 114.

In certain embodiments, the first structural beam 113 and the second structural beam 114 have a length of between about 2 feet and about 12 feet. In other embodiments, the first structural beam 113 and the second structural beam 114 have a length of between about 3 feet and about 8 feet.

In certain embodiments, the first structural beam 113 and the second structural beam 114 may have a generally square, round, I-beam, H-beam, or rectangular profile with a height and a width that are both between about 1 inch and about 24 inches. In other embodiments, the height and the width of the first structural beam 113 and the second structural beam 114 are both between about 2 inches and about 24 inches.

In certain embodiments, the first attachment assembly 105 and the second attachment assembly 106 may have a generally circular configuration, as illustrated in FIGS. 5 and 7. An outer skin 110 of the second attachment assembly 106 may be used for attaching the first structural beam 113 and the second structural beam 114, as illustrated in FIGS. 5 and 7.

A variety of techniques may be used for attaching the first structural beam 113 and the second structural beam 114 to the first attachment assembly 105. Examples of two such connection techniques are bolts and welding.

While the figures illustrate that there are six of the first structural beams 113 and the second structural beam 114 attached to the first attachment assembly 105, a person of skill in the art will appreciate that other numbers of first structural beam 113 and the second structural beam 114 may be attached to the first attachment assembly 105. An example of one such alternative configuration is attaching five of the first structural beams 113 and second structural beam 114 to the first attachment assembly 105. Another example of one such alternative configuration is attaching three structural members 113 to the second attachment assembly 106.

A cap section 104 of the oil containment recovery dome 100 may be separable from the other portions of the oil containment recovery dome 100. Such a configuration enables relatively large size objects to be placed within the oil containment recovery dome 100. An example of one such relatively large size object is a super blowout preventer. The cap section 104 may split, be but limited, into multiple configurations as illustrated in FIG. 6.

Figure 6:
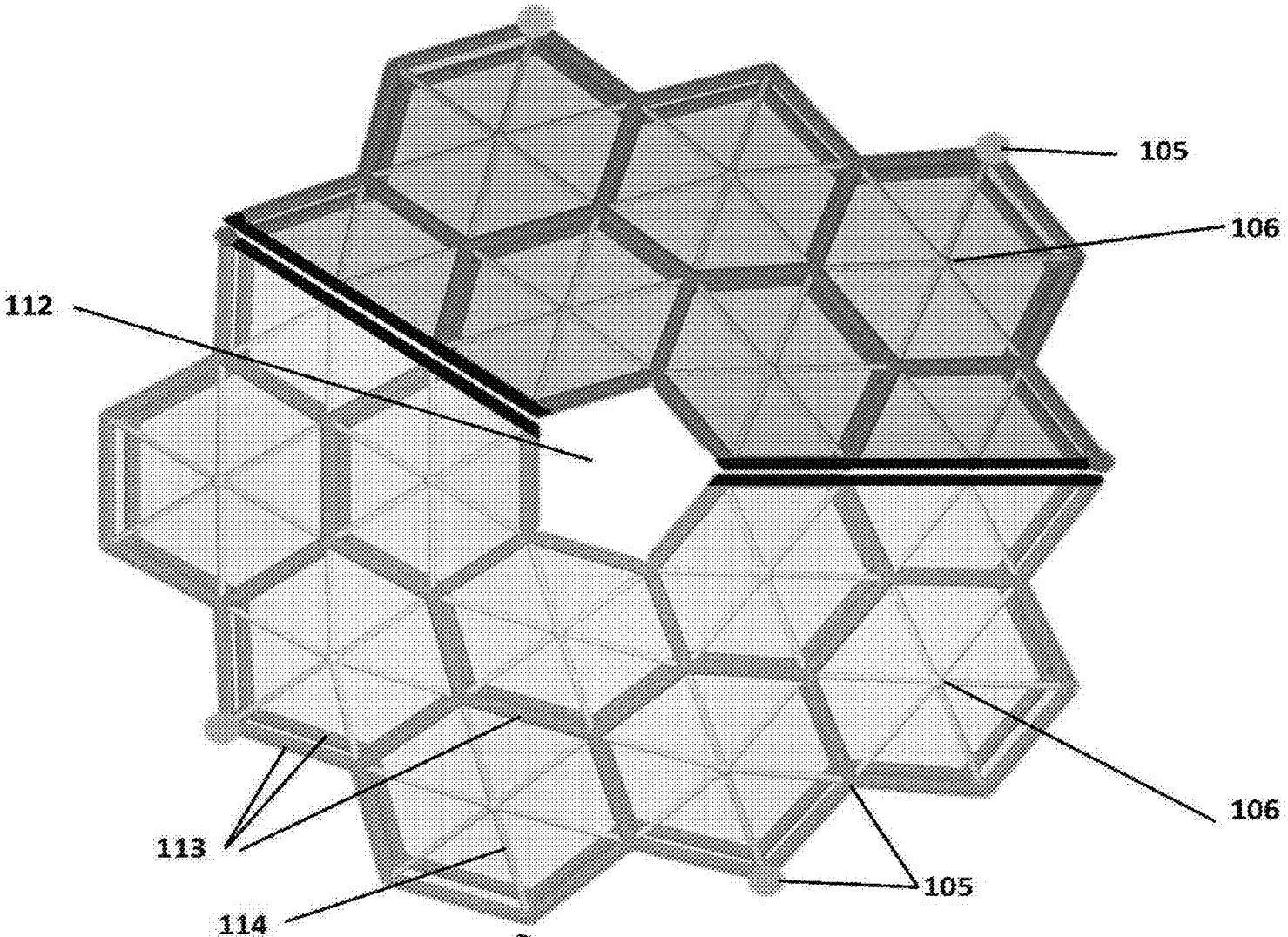
FIG. 6 is plan a view of a top cap portion of the oil containment recovery dome of FIGS. 1 and 2.

The cap section 104 may be fabricated similar to the other aspects of the upper sphere section 101 in that the cap section 104 includes a plurality of the first structural beam 113 and the second structural beam 114 that are each attached to the first attachment assembly 105 and the second attachment assembly 106, as illustrated in FIGS. 5, 6 and 7.

The cap section 104 may also include a plurality of outer skin 110 and inner skin 111 attached to an upper surface thereof. The outer skin 110 may have a generally triangular shape so that each of the outer skin 110 substantially covers an opening between adjacent first structural beam 113 and the second structural beam 114.

The outer skin 110 and inner skin 111 may be fabricated from a variety of materials using the concepts of the invention. The outer skin 110 and inner skin 111 should have sufficient strength to resist deformation and breakage under the conditions at which the oil containment recovery dome 100 is utilized.

In certain embodiments, the outer skin dome assembly 110 may be fabricated from a different material than the inner skin dome assembly 111. An example of one such configuration is that the outer skin dome assembly 110 is fabricated from a stronger material than the material used to fabricate the inner skin dome assembly 111.

The outer skin 110 should also resist degradation when exposed to the materials in which the oil containment recovery dome 100 is used such as salt and organisms present in ocean water. Examples of two such materials that may be utilized to fabricate the outer skin 110 are metallic or polymeric sheets. The outer skin may be porous like a cage structure when the inner skin 110 is functioning to contain an oil leak.

A variety of techniques may be used to attach the outer skin 110 and the inner skin 111. As is discussed in more detail below, the technique used to attach the outer skin 110 and inner skin 111 to the other elements of the sphere 101 and the cap section 104 need only be capable of containing oil within by means of one of the skins.

An example of one such suitable technique to attach the outer skin 110 to the other portions of the cap section 104 is by positioning the edges of the outer skin 110 between the structural beam 113 and structural beam 114 and a seam covering cap (not shown) and then using a fastening device such as a screw or bolt to attach the seam covering cap to the first structural beam 113 and structural beam 114.

In certain embodiments, an ocean resistant material with porous pattern may be used for the outer skin 110 in conjunction with the oil containment recovery dome 100. Such a porous material may be similar to metal cyclone fencing and may prevent sea creatures from entering the interior of the oil containment recovery dome 100.

As illustrated in FIGS. 5 and 7, the first attachment assembly 105 may also accept mooring anchors 115 and cables 117 such as are illustrated in FIG. 2. The first attachment assembly 105 is structurally capable to accept matching connectors (not shown) to be used with attachments for transport of the oil containment recovery dome 100 to and from the installation site by air, surface sea or below sea surface as illustrated in FIGS. 12, 13, 15, 18, 25, 26*a* , 26*b*, 27*a* , 30 and 31.

As illustrated in FIGS. 5 and 7, the second attachment assembly 106 may accept a plurality of quick release accessories (not shown). The second attachment assembly 106 is able to receive a matching connector (not shown) for a pipe, feeder line, or other conduit (not shown) that is used to transport the oil from the ground surface beneath the body of water to the upper surface of the water where the oil is transferred to a ship or barge used to transfer the oil and gas to a location where the oil and gas is refined into finished products.

The second attachment assembly 106 may accept a plurality of quick release accessories (not shown). The second attachment assembly 106 may be to receive a pipe or other conduit (not shown) that is used to receive lighter than air or seawater liquids or gasses to be pumped into a buoyancy/ballast tank 108 and/or buoyancy/ballast tank bladder 109 illustrated in FIGS. 5 and 7.

The buoyancy/ballast tank 108 and/or buoyancy/ballast tank bladder 109 are capable of being used during any of the aforementioned methods of transport of oil containment recovery dome 100.

It is possible for one of the connectors 105, 106 described herein to be used in conjunction with adding or removing material from the bladders 109. The connectors 105, 106 may also be used in conjunction with transporting oil or gas from the interior of the oil containment recovery dome 100 to a collection apparatus or vehicle.

The outer skin dome assembly 110 and the inner skin dome assembly 111 may each have a frame construction that includes a plurality of structural members and a plurality of hubs, which is similar to the oil containment recovery dome 100 illustrated in FIGS. 1-8.

It is possible for the outer skin dome assembly 110 and the inner skin dome assembly 111 to both have the same configuration. In certain embodiments, the outer skin dome assembly 110 may be fabricated with a generally triangular configuration, as most clearly illustrated in FIG. 9. In certain embodiments, the outer skin dome assembly 110 may be fabricated with a generally hexagonal/polygonal configuration, as most clearly illustrated in FIG. 10.

Figure 19:
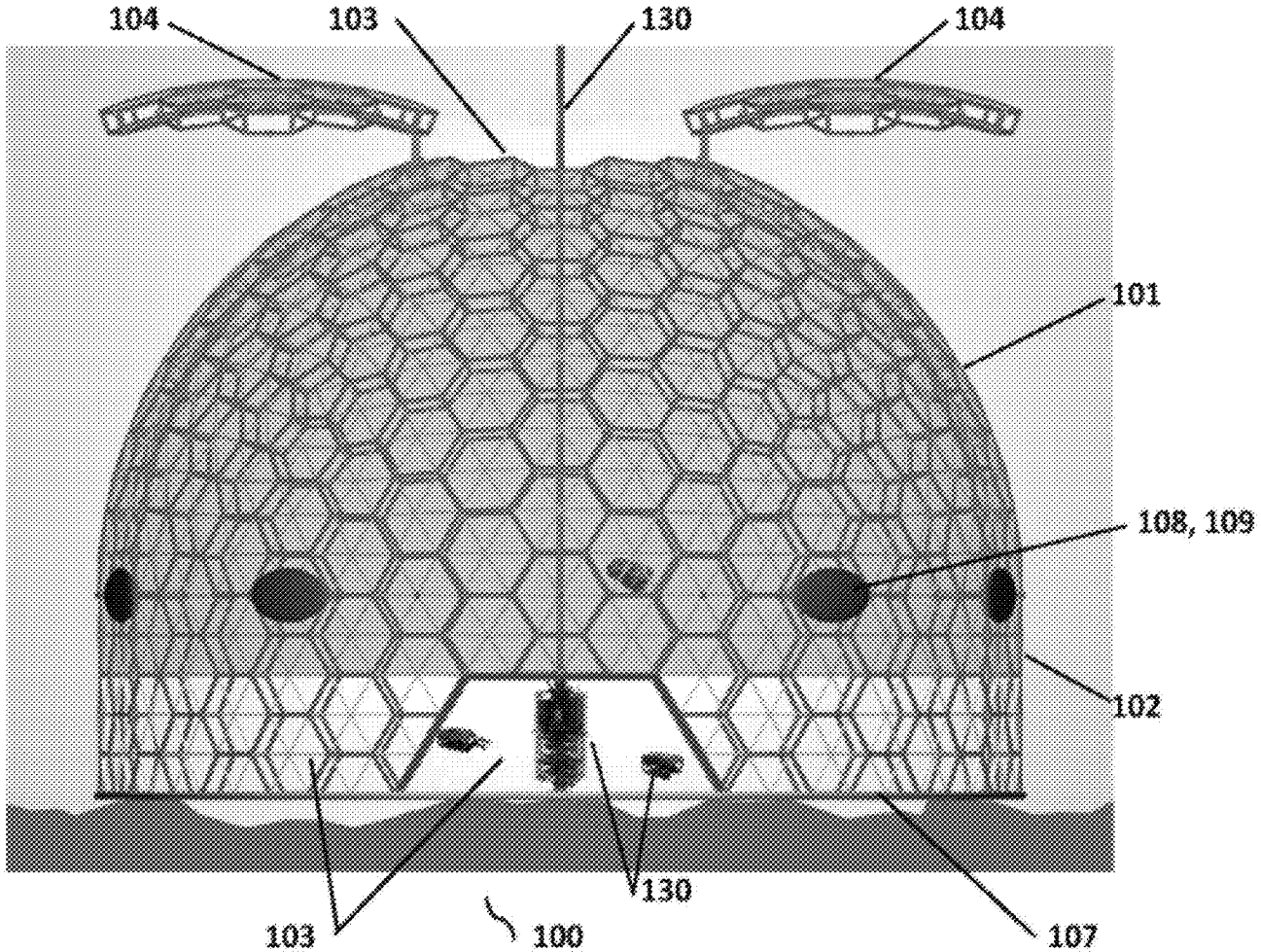
FIG. 19 is a profile view of the oil containment recovery dome illustrated in FIG. 4 moored on sea floor with moveable split cap open and oil equipment working within.

The outer skin dome assembly 110 and the inner skin dome assembly 111 may be interconnected by a plurality of connecting members, as most clearly illustrated in FIG. 19. Interconnecting the inner skin dome assembly 111 and the outer skin dome assembly 110 enhances the strength of the oil containment recovery dome 100.

In certain embodiments, one of the connecting members extends between the most proximate the first attachment assembly 105, on the outer skin dome assembly 110 and the first attachment assembly 105 on the inner skin dome assembly 111. The first attachment assembly 105, thereby enhancing the rigidity of the oil containment recovery dome 100.

The first attachment assembly 105, may be fabricated from the same type of materials that are used to fabricate structural members that are used to fabricate at least one of the outer skin dome assembly 110 and the inner skin dome assembly 111.

A variety of techniques may be used to attach the first attachment assembly 105, the second attachment assembly 106, and the outer skin dome assembly 110 and the inner skin dome assembly 111.

The first attachment assembly 105, the first attachment assembly 105, and the outer skin dome assembly 110 and the inner skin dome assembly 111 may be fabricated from a variety of materials. The materials used to fabricate these components should enable the oil containment recovery dome 100 to resist deformation when forces are applied to the oil containment recovery dome 100.

Additionally, the materials used to fabricate these components should resist degradation when exposed to the extreme pressures and/or temperatures typically found where deep-water wells are drilled. The materials used to fabricate these components should also resist degradation caused by extended exposure to the materials and/or microorganisms present in the water where the oil containment recovery dome 100 is installed.

Examples of materials that may be used to fabricate the connecting members, the structural members, and the hubs are stainless steel, titanium, magnesium, fiberglass, and carbon fiber and fiber composites. To further reduce the potential of degradation of these components, these components may be coated with a protective material.

At least one of the outer skin dome assembly 110 and the inner skin dome assembly 111 may include a plurality of outer skin panels 110 that are attached to the structural members to each substantially cover the openings. Similar to the outer skin 110 and inner skin 111 used in conjunction with the oil containment recovery dome 100 illustrated in FIGS. 1-11, the inner skin 111 is attached to the structural members to form a water-tight seal in certain embodiments.

In other embodiments, a sheet of cover material is placed over a plurality of the openings on at least one of the inner surface of the inner skin dome assembly 111 or the outer surface of the outer skin dome assembly 110. The sheet of material may be fabricated from a variety of materials using the concepts of the invention. An example of one such suitable material is non-inflated ETFE fabric.

To prevent damage to the cover material such as when the oil containment recovery dome 100 is being lowered into the position above the oil well, at least a portion of the openings may be covered with a temporary panel (not shown) that is fabricated from a more rigid material. An example of the rigid material is treated plywood. The oil containment recovery dome 100 may have 12" to 18" metal spikes attached as attachment assembly to the triangle node connections. These spikes are to ward off sea creatures, the final configuration akin to a giant sea urchin.

Once the oil containment recovery dome 100 is lowered into position, the temporary rigid panels may be removed. Alternatively, the rigid panels may be allowed to degrade as a result of the continued exposure to the materials and/or organisms present in the water where the oil containment recovery dome 100 is installed.

In the configuration of the cap section 104, at least one outer skin panel 110 or inner skin 111 is replaced with a flexible riser boot 112 for use in accepting a feeder line 116, as illustrated in FIG. 6. The riser boot 112 may have a shape that is similar to the outer skin panel 110 and inner skin panel 111 for the area penetrated by oil drilling and collection equipment (not shown).

The cap section 104 includes at least one, but not limited to, cap section 104 that is positionable in a closed configuration and an open configuration. When in closed configuration, the at-least-one cap section 104 substantially restricts the flow of water and/or oil through the open section 103 as illustrated in FIGS. 2, 4, 19 and 20.

When in the open configuration, the at-least-one cap section 104 substantially permits water and/or oil to pass through the open section 103. It is also possible to position the at-least-one cap section 104 in an intermediate configuration that is between the open configuration and the closed configuration to partially restrict the flow of water and/or oil through the open section 103 located in the sphere section 101 of dome 100.

Figure 20:
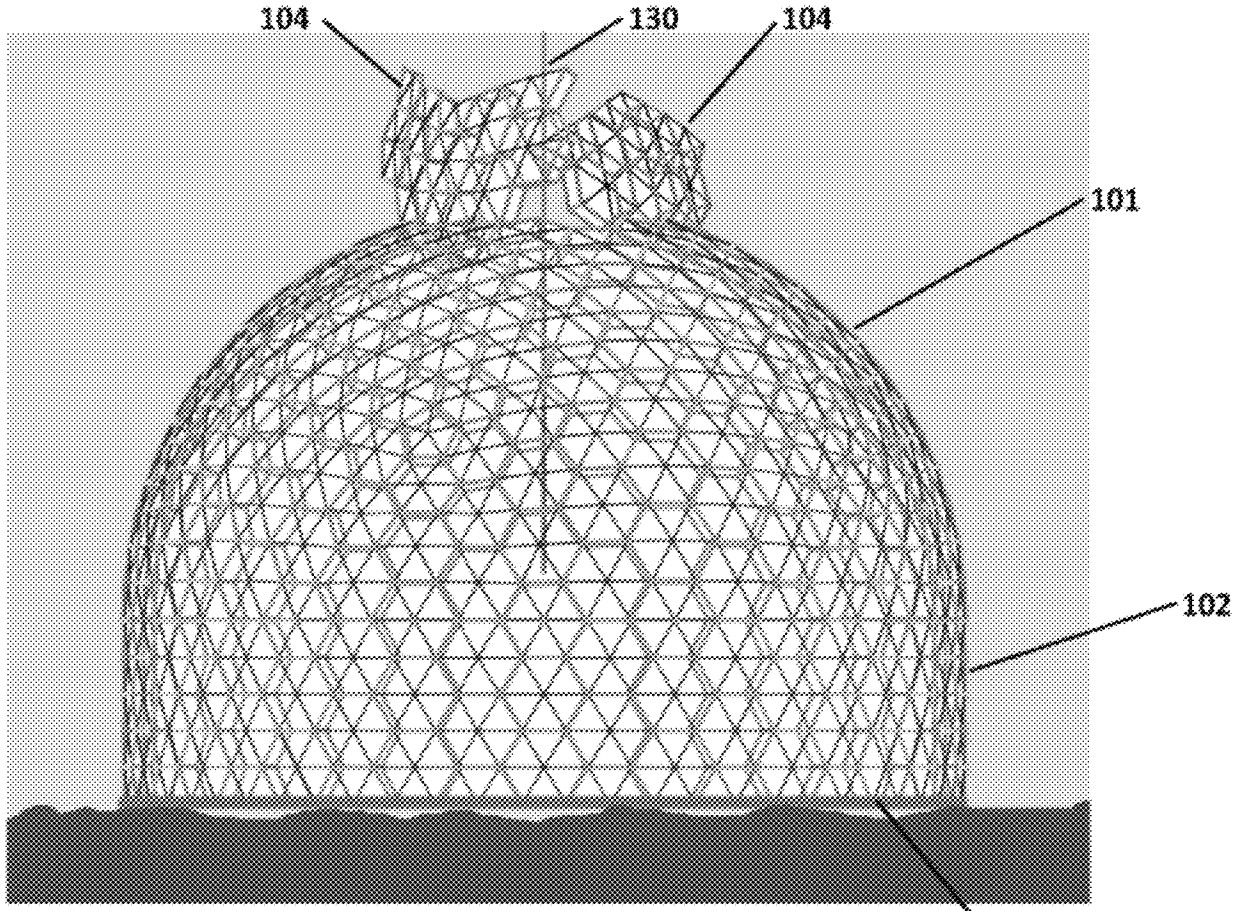
FIG. 20 is a profile view of an outer dome and inner dome frame assembly of the oil containment recovery dome illustrated in FIG. 4 showing an opening alternate cap illustrated in FIG. 6.

The cap section 104 may be operable using a variety of methods. In one such method, cap section 104 is pivotally mounted so that cap 104 can pivot between the open configuration and the closed configuration as illustrated in FIGS. 19 and 20. Another possible configuration for the storage of the cap section 104 is for the at-least-one cap section 104 to be moved to an open configuration by robotic operating vehicles ("ROVs") (not shown) and temporally moored on a space truss and staging platform 300 illustrated in FIGS. 18 and 21.

An example of one suitable technique for attaching the top section to the other portions of the oil containment recovery dome 100 is a stiffening space truss around the interface between the cap section 104 and upper sphere section. This allows the top section to open by pivot as FIGS. 4, 19 and 20.

In certain embodiments, the cap section 104 may be biased to a closed configuration. Installed monitoring devices in first structural beam 113 may be used to measure pressure differences between the interior and exterior of dome 100 as well as temperature, water composition and other desired data collection properties. Conduits may be used to feed these and other devices related to gas-gaseous control.

As an alternative to fabricating the oil containment recovery dome 100 with the structural members 113 and 114, it is possible to use alternative systems to control the ability of water and/or oil to flow into and out of the oil containment recovery dome 100. Such alternative systems should be capable of operating in a highly reliable manner at high pressures and/or low temperatures. An example of one such alternative system is a check valve.

The oil containment recovery dome 100 may include a pressure flow vent (not shown) that is capable of releasing excess pressure generated within the oil containment recovery dome 100 and thereby minimize the potential of damage of the oil containment recovery dome 100 by such excess pressure.

In certain embodiments, the pressure flow vent is a diaphragm check valve that is activatable in response to a specific cracking pressure within the oil containment recovery dome 100. Flowage control by directing the leak close to the source will better enable gas venting to minimize the potential of damage of the oil containment recovery dome 100. Similar to other embodiments discussed in this patent application, it is also possible to use louvers to release pressure from inside of the oil containment recovery dome 100 through the first attachment assembly 105 and or open section 103.

Each of the cap sections 104 in the upper sphere section 101 that are defined by the first structural beams 113 and the second structural beams 114 are substantially covered with an outer skin 110 and an inner skin 111, with structural members 113 and 114, configured with their appropriate accessory hardware, as illustrated in FIG. 7.

A percentage of the surface of the oil containment recovery dome 100 that contains the buoyancy/ballast tanks 108 and buoyancy/ballast tank bladders 109 may be determined based upon a variety of factors. One such factor is the amount of water and/or oil that is desired to flow through the oil containment recovery dome 100 such as when lowering the oil containment recovery dome 100 from the top of the body of water to the ground surface beneath the body of water.

In certain embodiments, between about 25 percent and about 75 percent of the surface of the oil containment recovery dome 100 contains buoyancy/ballast tanks 108 and buoyancy/ballast tank bladders 109. In other embodiments, between about 40 percent and about 60 percent of the surface of the oil containment recovery dome 100 is covered with the buoyancy/ballast tanks 108 and buoyancy/ballast tank bladders 109.

The cylinder section 102 is positioned along and may extend substantially around the lower edge of the upper sphere section 101, as illustrated in FIG. 2. The cylinder section 102 may have a height that is considerably smaller or higher than a height of the sphere section 101.

While the cylinder section 102 is illustrated as being oriented in a substantially vertical orientation, it is also possible for the cylinder section 102 to have other orientations.

In certain embodiments, the cylinder section 102 may have a height of between about 1 foot and about 50 feet. In other embodiments, the cylinder section 102 has a height of between about 5 feet and about 100 feet.

The cylinder section 102 may be fabricated with at least one opening 103 that has a width and a height that are sufficiently large to permit equipment such as ROVs that are used in conjunction with drilling the oil well and/or addressing issues relating to leaks from the oil to be moved into and out of an interior region of the oil containment recovery dome 100.

In certain embodiments, each of the openings 103 may have a height of between about 5 feet and about 60 feet and a width of between about 5 feet and about 60 feet. In other embodiments, the openings may have a height of about 40 feet and a width of about 80 feet.

It is possible for the openings to be formed with different heights and widths depending on the equipment that is to pass through the openings. In other embodiments, each of the openings is formed with a height and a width that are approximately the same.

In certain embodiments, a plurality of openings 103 are provided on the cylinder section 102 and such openings are positioned in a spaced-apart configuration. For example, there may be 5 to 6 openings or more in the cylinder section 102. Using the plurality of openings enables multiple ROVs to be simultaneously used to perform work within the oil containment recovery dome 100.

Open sections 103 are provided around the base of the oil containment recovery dome 100 as illustrated in FIGS. 2, 4, 12 19, 26, 27, and 28. By fabricating the oil containment recovery dome 100 in this manner, it is possible for water to flow into the interior of the oil containment recovery dome 100 as the leaked oil is withdrawn from the interior of the oil containment recovery dome 100.

Such a configuration allows pressure on the outside and inside of the oil containment recovery dome 100 to remain substantially the same to thereby minimize the creation of a pressure differential, which could lead to damage of the oil containment recovery dome 100. It should be noted that the lower portion of the oil containment recovery dome structure is open to the sea (atmospheric) pressure. Approximately, up to 20% of the lower dome structure is open to sea pressure, providing the remaining upper structure available to collect the lighter-than-seawater crude oil.

The cylinder section 102 may be fabricated from the same materials that are used to fabricate the sphere section 101. An example of one such configuration is a plurality of elongated members and a plurality of connectors that are attached together to form an array.

The angle of the base of cylinder section 102 may accommodate for different ground slope around the oil containment recovery dome 100. To account for variations in the shape and/or orientation of the ground surface on which the oil containment recovery dome 100 is placed a buoyancy/ballast bridging ring 107.

The buoyancy/ballast bridging ring 107 can span great distances to provide uniform distribution of structural loads to be dumped into the ground. The buoyancy/ballast bridging ring 107 may also be filled with ballast to assist in securing the oil containment recovery dome 100 to the ground by using mooring anchors 115 as illustrated in FIGS. 2 and 8.

While it is desirable for a lower edge of the cylinder section 102 to be positioned relatively close to the ground surface, it is generally not required for the lower edge of the cylinder section 102 to be positioned immediately adjacent to the ground surface or that a water-tight seal be formed between the lower edge of the cylinder section 102 and the ground surface.

In certain embodiments, a distance between the lower edge and the ground surface may be more than about 48 inches.

Figure 8:
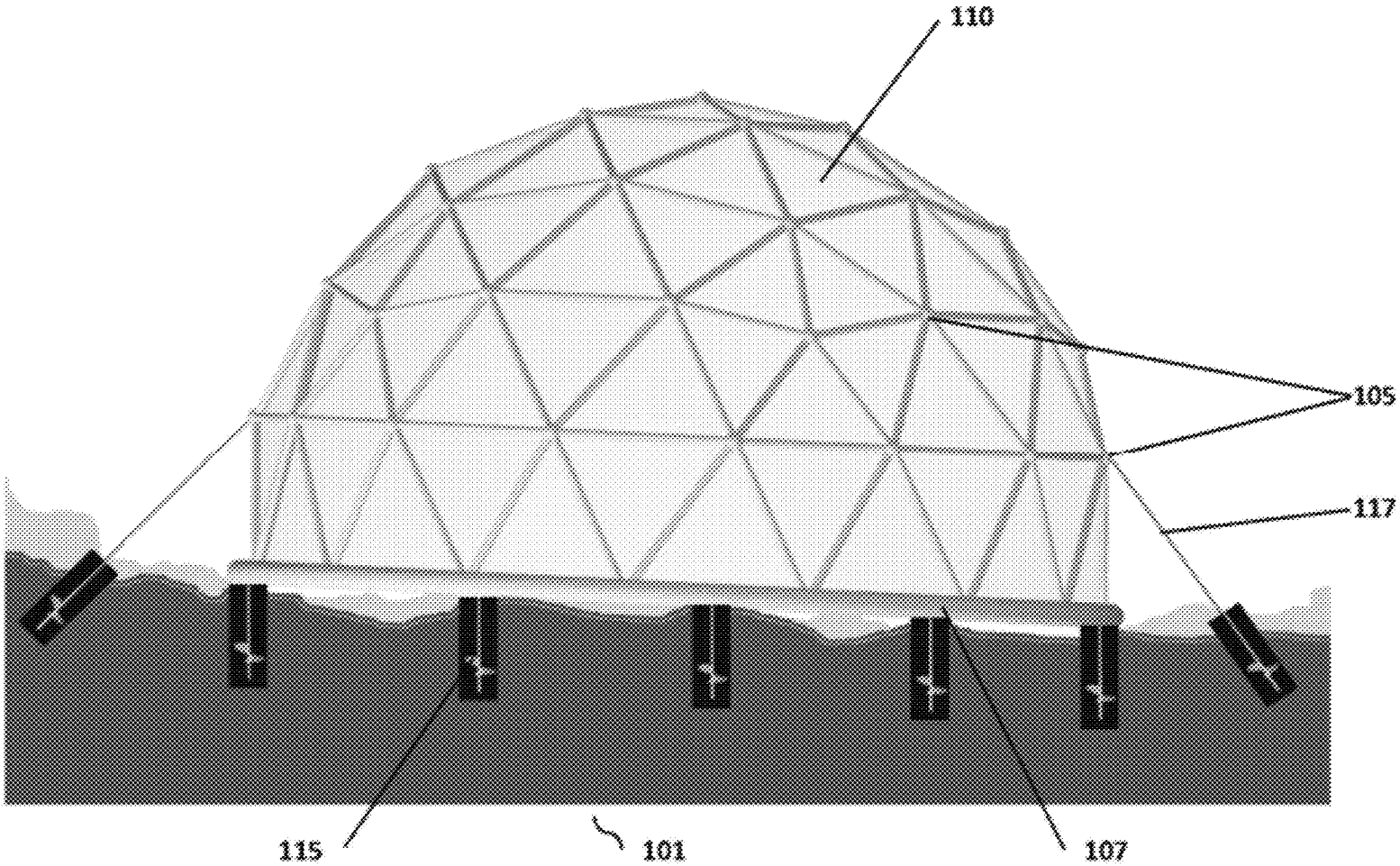
FIG. 8 is an profile view of an alternative configuration of the oil containment recovery dome of FIG. 1 attached to a ground surface located beneath a body of water using a plurality of anchors and cables.

As illustrated in FIGS. 2 and 8, a plurality of mooring anchors 115 may be provided along the lower edge of the cylinder section 102. The mooring anchors 115 may be positioned in a spaced-apart configuration so that the mooring anchors 115 provide support around the oil containment recovery dome 100.

The mooring anchors 115 may have an adjustable height that enables the height of the mooring anchors 115 to change in response to difference in shape and orientation of the ground surface. In certain embodiments, the mooring anchors 115 may have a bias mechanism mounted therein that allows the height of the mooring anchors 115 to adjust.

In certain embodiments, it may be desirable to use an attachment or mounting mechanism to maintain the oil containment recovery dome 100 in a substantially stationary position with respect to the ground surface. One potential configuration is placing ballast in the buoyancy/ballast bridging ring 107 around the oil containment recovery dome 100.

Another technique that may be used to restrict movement of the oil containment recovery dome 100 is a plurality of cables 117 that extend from oil containment recovery dome 100 and are attached to the ground surface, as illustrated in FIGS. 2, 8, 26*b* and 27*a*. The cables 117 may be attached at differing heights on the oil containment recovery dome 100.

In operation, the oil containment recovery dome 100 may be fabricated above the surface of the body of water in which the oil containment recovery dome 100 is to be used because assembly in such conditions is typically easier than assembling the components below the water surface. In such situations, the oil containment recovery dome 100 may be transported to the location where the oil well is intended to be drilled.

Depending on the size of the oil containment recovery dome 100, it may be necessary to increase buoyancy or stabilize with ballast for transport to installation site. Increased buoyancy or stabilization with ballast can be accomplished by filling buoyancy/ballast tanks 108 and buoyancy/ballast tank bladders 109 with appropriate amounts of buoyancy/ballast materials.

Figure 12:
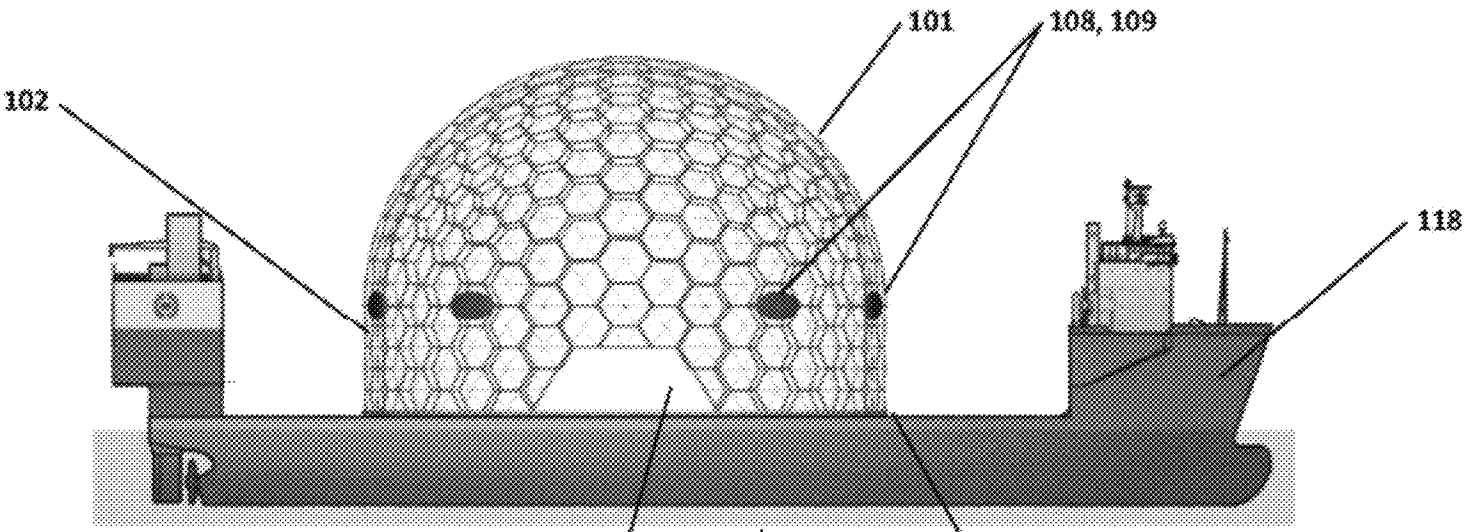
FIG. 12 is a profile view of the oil containment recovery dome of FIG. 1 being transported to spill site by sea container ship.
Figure 13:
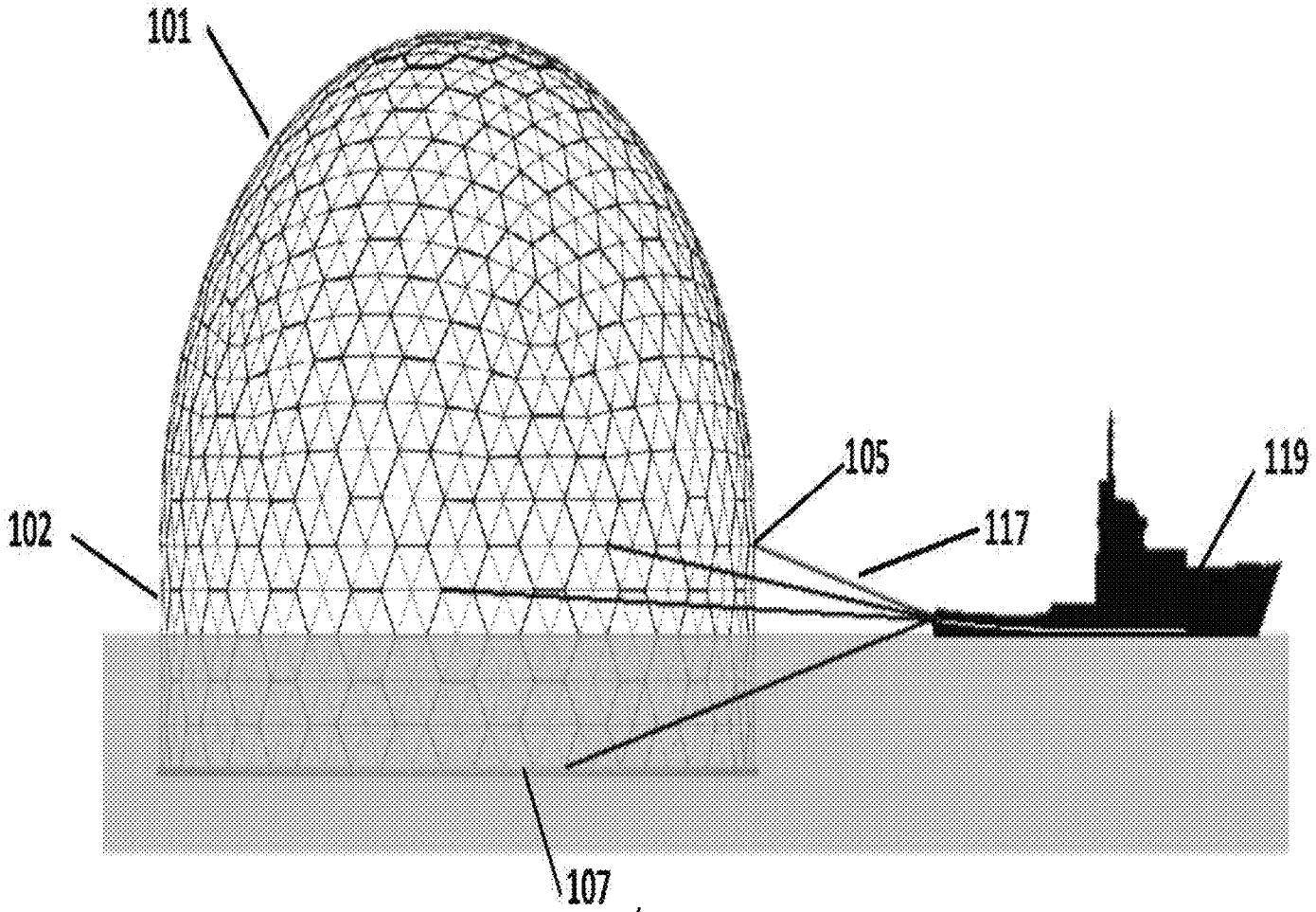
FIG. 13 is a profile view of the oil containment recovery dome of FIG. 1 being transported to spill site by sea tug.
Figure 14:
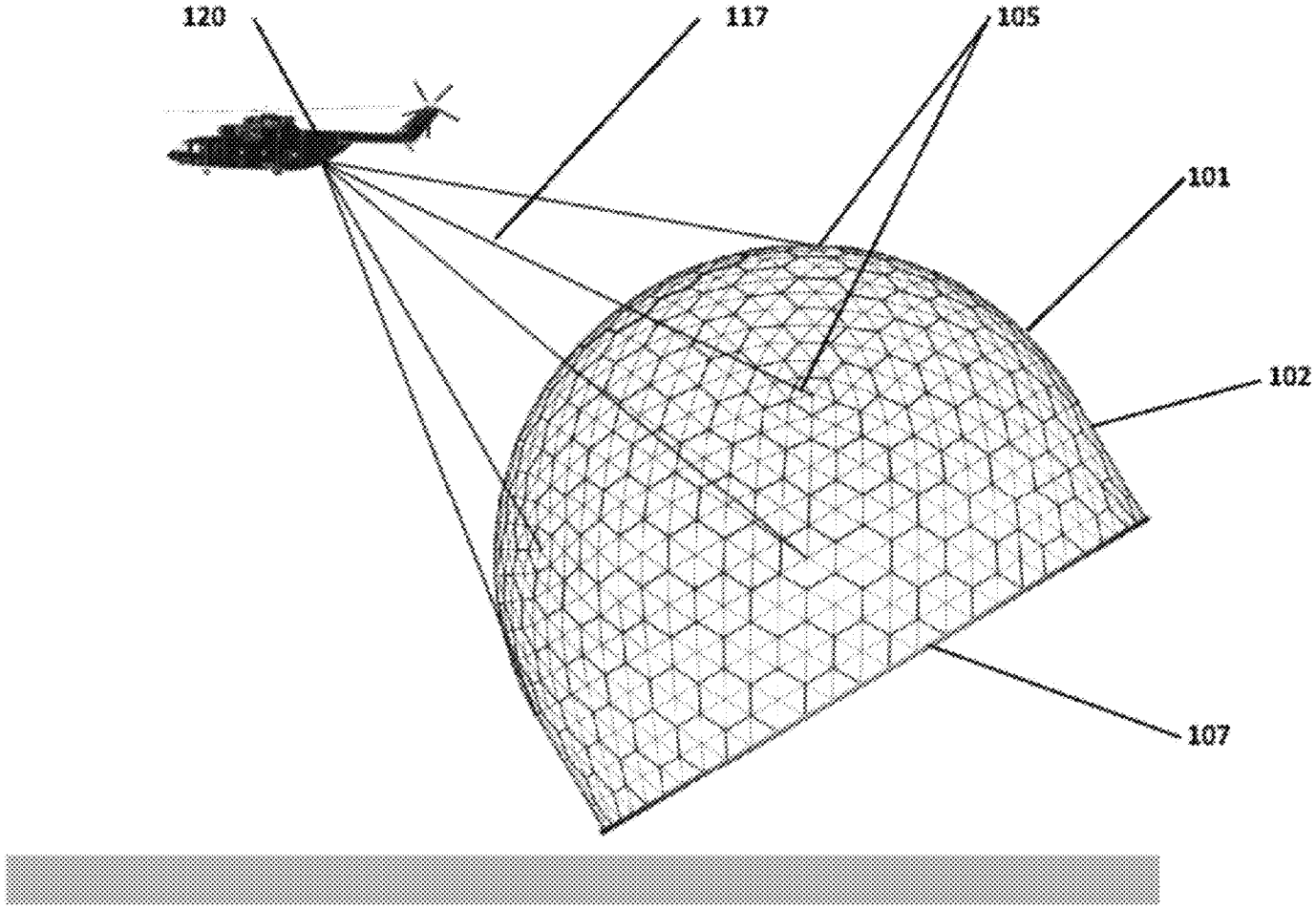
FIG. 14 is a side view of the oil containment recovery dome of FIG. 1 being transported to spill site by helo crane or dirigible-blimp.
Figure 15:
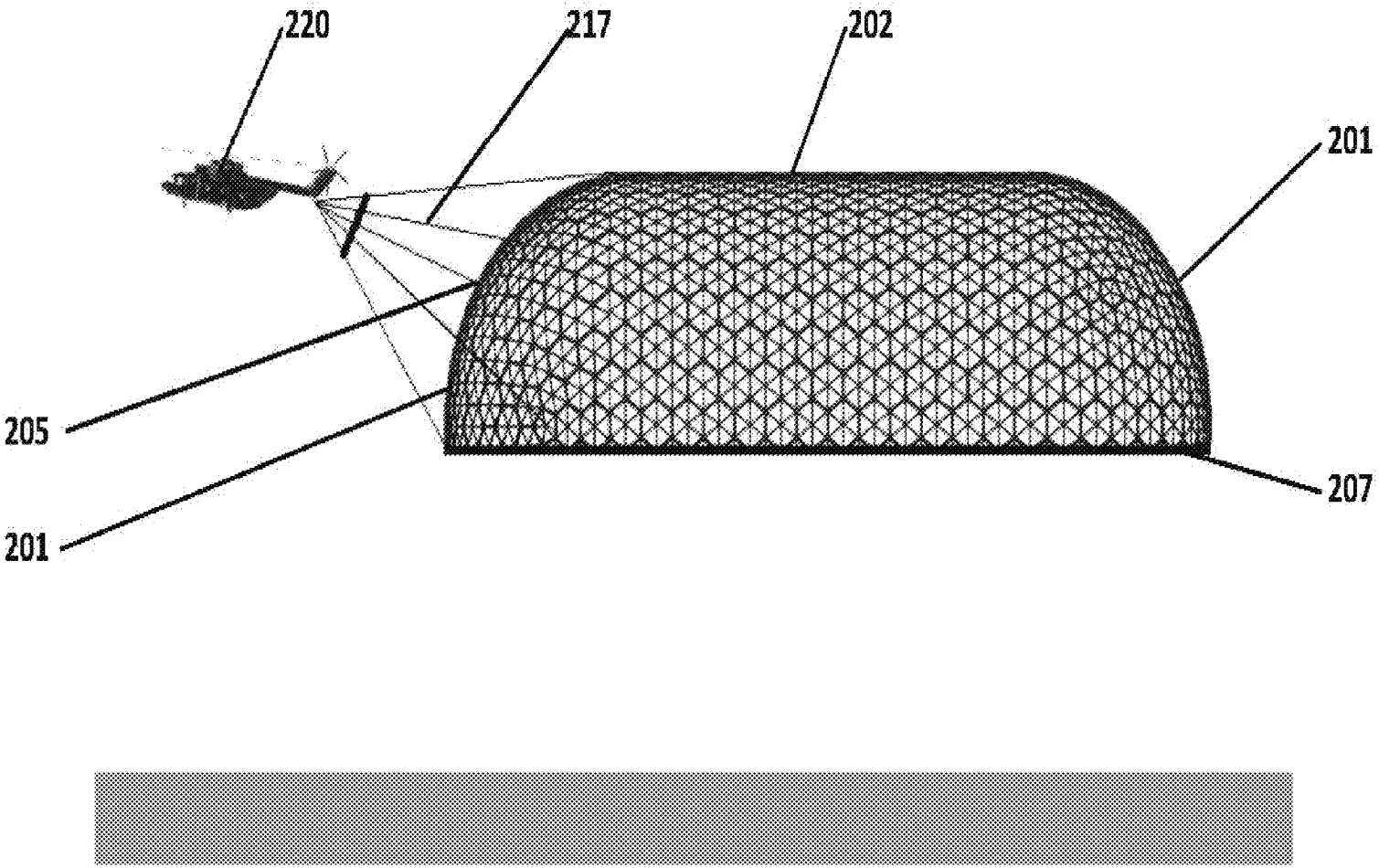
FIG. 15 is a profile view of oil containment recovery dome of FIG. 9 being transported to spill site by helo crane or dirigible-blimp.
Figure 23:
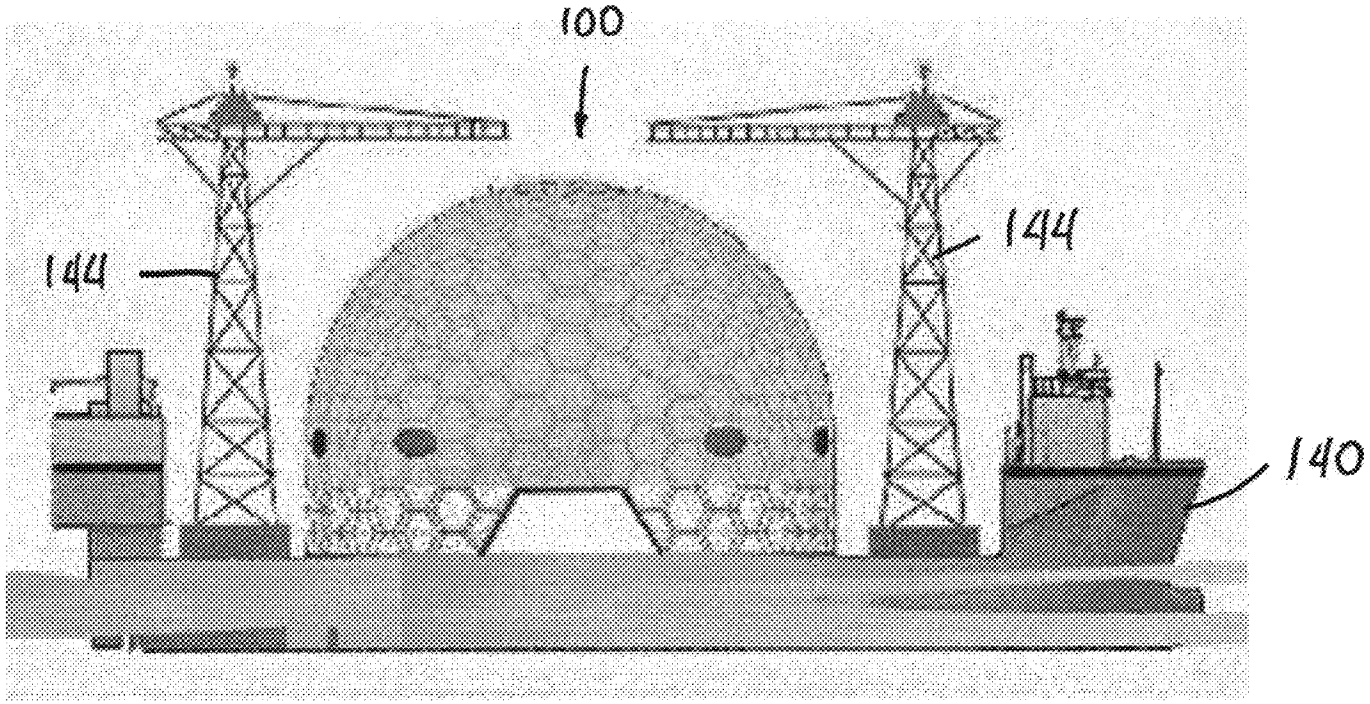
FIG. 23 is a side view of an oil containment recovery system on a transport vessel.
Figure 24:
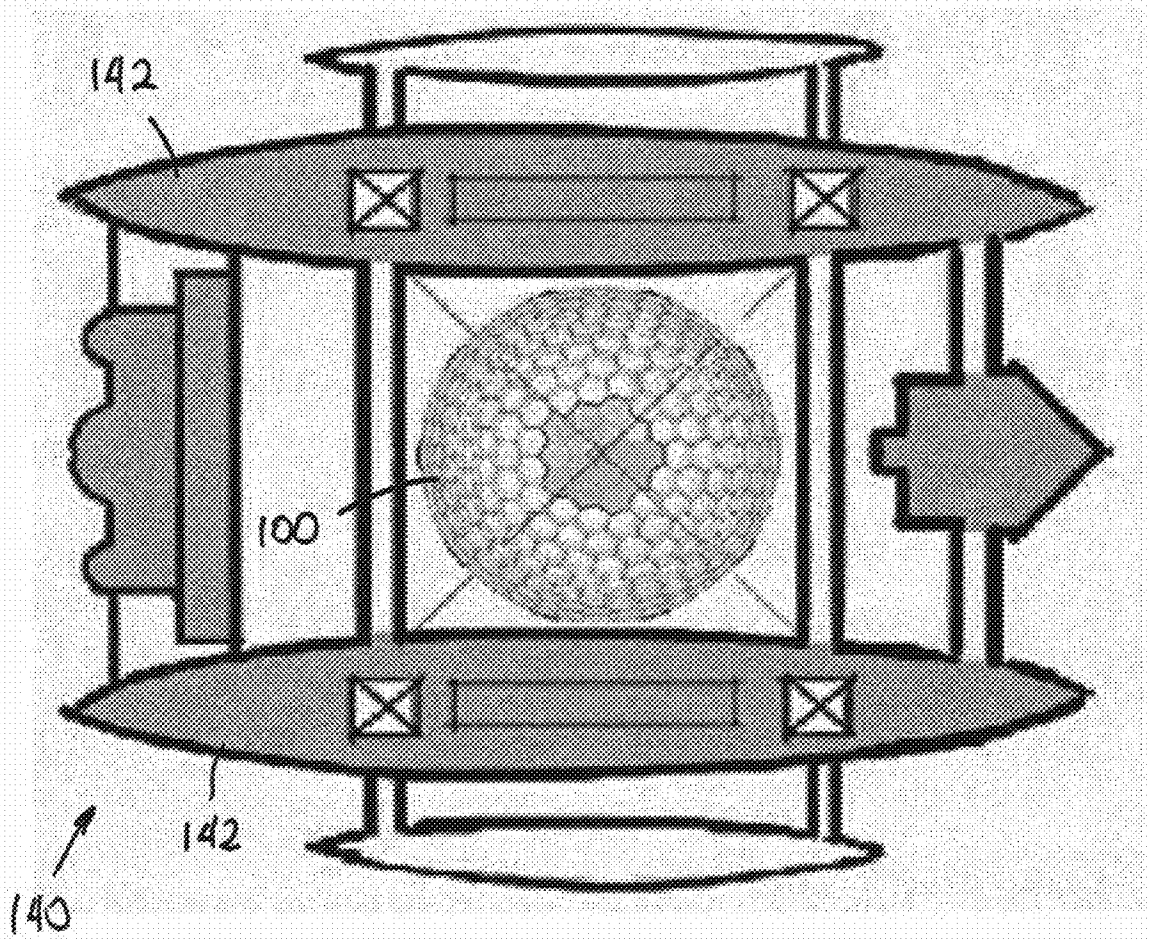
FIG. 24 is a plan view of the oil containment recovery system utilizing a dual hull transport vessel illustrated in FIG. 23.

An option for transporting the oil containment recovery dome 100 is to float the oil containment recovery dome 100 to site by use of sea transport tug boats 119 such as is illustrated in FIG. 13. Still another option using buoyancy/ballast assist is to use helo crane, dirigibles-blimps, as illustrated in FIG. 14. Another option for transporting the oil containment recovery dome 100 is to place the oil containment recovery dome 100 on the surface of a heavy cargo transport ship 118 as illustrated in FIG. 12 or use a catamaran ship 140 for transport as illustrated in FIGS. 23 and 24. For all cases first attachment assembly 105 may be used for transport attachments.

The catamaran transport ship 140 option provides a ship that includes two hulls 142 mounted in a spaced apart configuration, as illustrated in FIGS. 23 and 24.

The hulls 142 may be movable with respect to each other so that the hulls 142 can be positioned relatively close to each other while the transport ship 140 is moved to where the well is being drilled.

Figure 25:
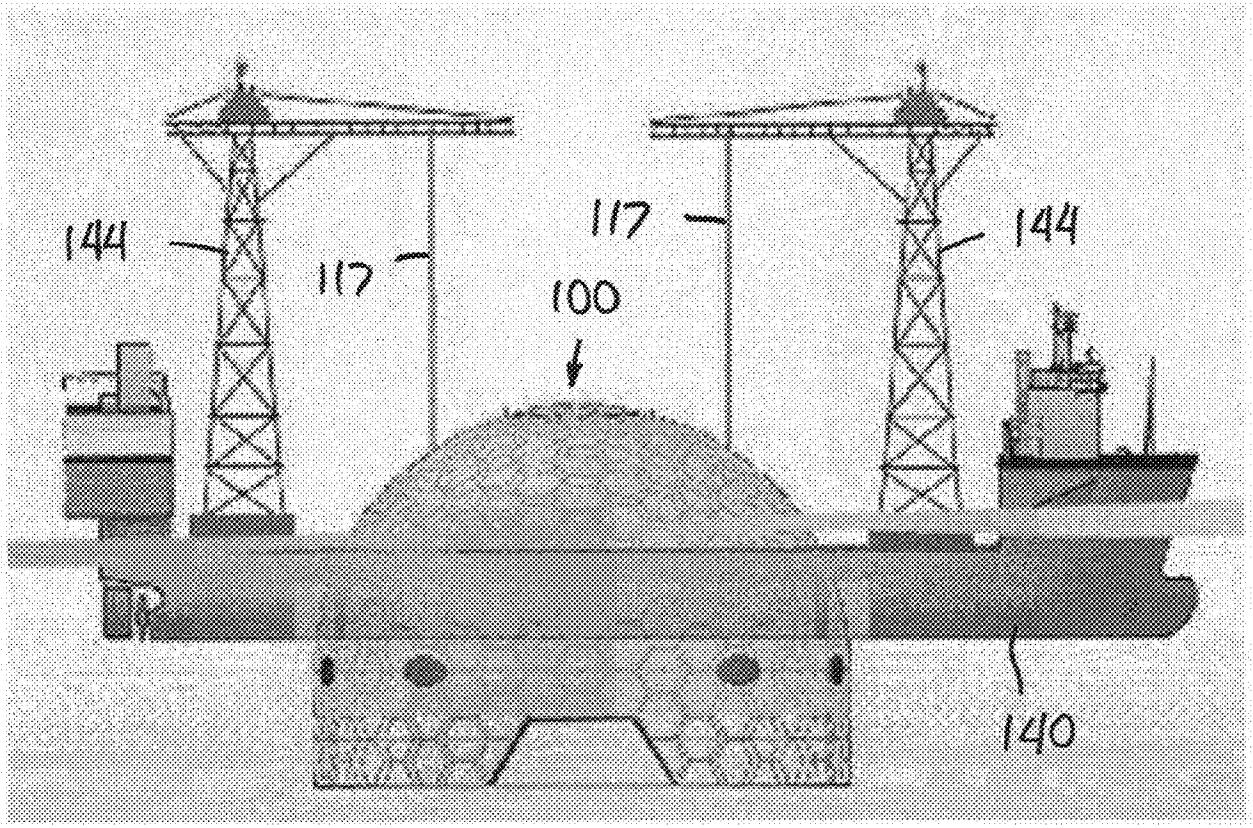
FIG. 25 is a side view of the oil containment recovery system utilizing cranes on the transport vessel of FIGS. 23 and 24 to lower into water.
Figure 26B:
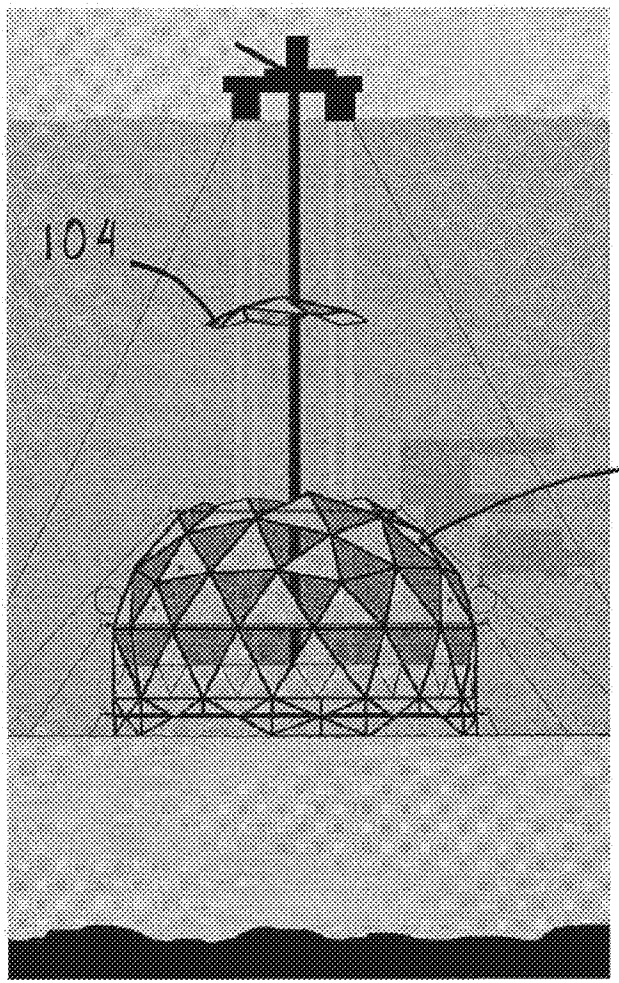
FIGS. 26*a*, 26*b*, and 26*c* are side views of the oil containment recovery system, lowering to the sea bottom of the body of water.
Figure 26A:
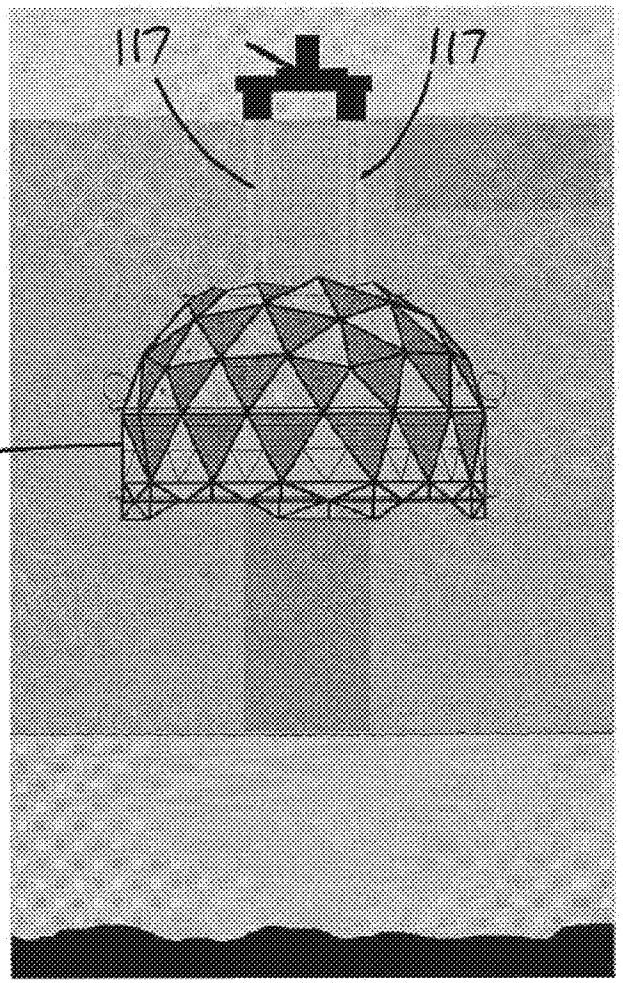
Figure 26C:
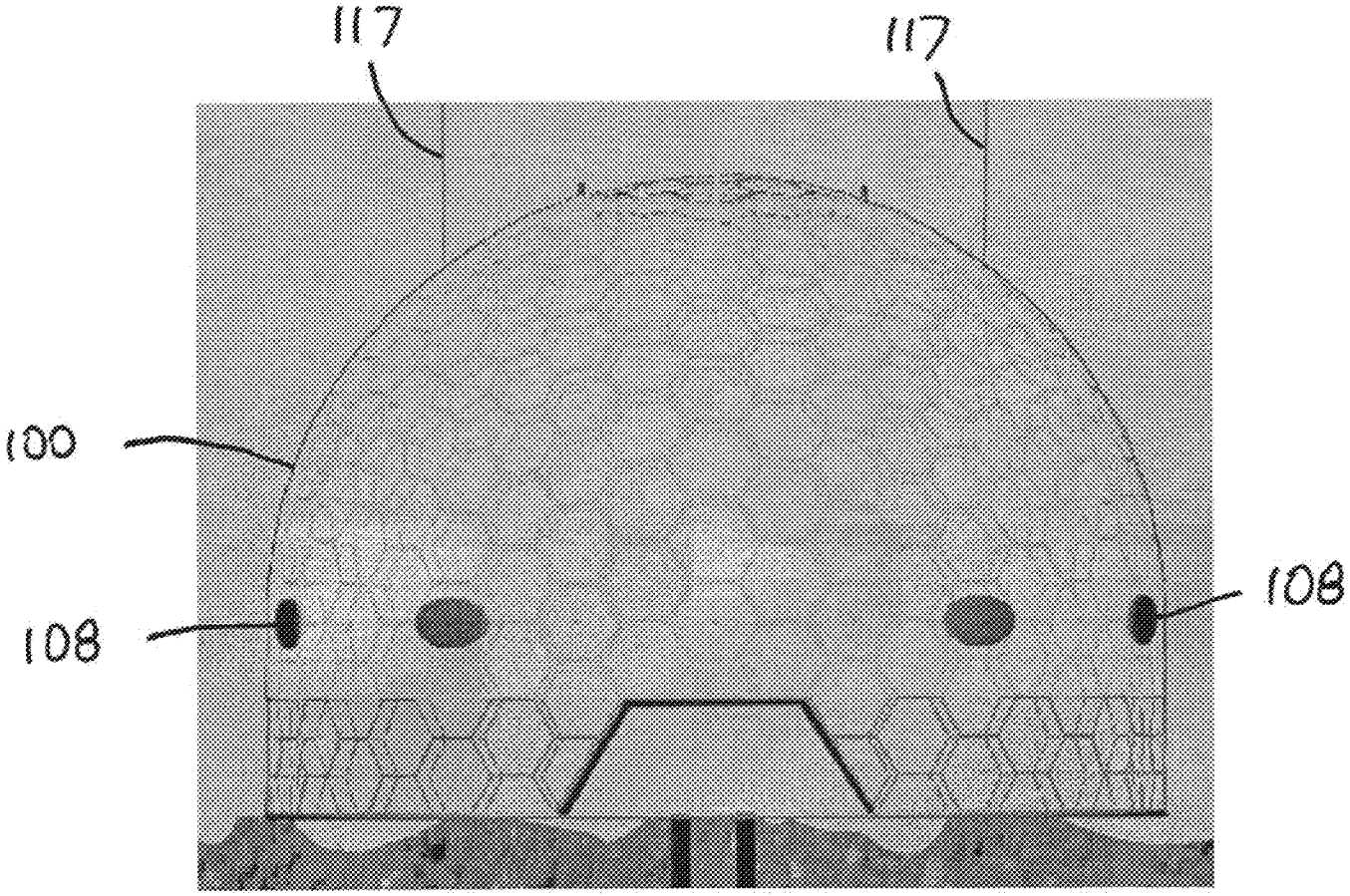

The transport ship 140 may include at least one crane 144 that is used to lift the oil containment recovery dome 100 off of the hulls 142 and then allow the oil containment recovery dome 100 to descend through the water, as illustrated in FIG. 25.

Once the area where the oil well is intended to be drilled is reached, the oil containment recovery dome 100 may be lowered through the body of water towards the ground surface beneath the body of water. An example of one such suitable technique is a dynamically positionable transport ship 140 as illustrated in FIGS. 23, 24 and 25.

To reduce the potential of damage to the oil containment recovery dome 100, the oil containment recovery dome 100 may be attached to a plurality of cables 117 for lowering to the ground surface, as illustrated in FIGS. 2, 23, 23, 25, 26*a* and 26*b*. The cables 117 may not only be used to guide the ascent of the oil containment recovery dome 100 but may also be used to assist with the ascent of the oil containment recovery dome 100.

As with the other forms of transport, it may be necessary to increase buoyancy or stabilize with ballast for transport to installation site. Increase buoyancy or stabilize with ballast can be accomplished by filling buoyancy/ballast tanks 108, buoyancy/ballast tank bladders 109 and buoyancy/ballast bridging ring 107 with appropriate amounts of buoyancy/ballast materials.

In certain embodiments, to enhance the ability to lower the oil containment recovery dome 100 through the body of water, the cap section 104 of the oil containment recovery dome 100 may be detached from the other portions of the oil containment recovery dome 100 as the oil containment recovery dome 100 is being lowered to the ground surface beneath the body of water.

To increase the weight of the oil containment recovery dome 100 and thereby stabilize and increase the rate at which the oil containment recovery dome 100 can descend through the body of water, a plurality of weights may be attached to the oil containment recovery dome 100. The weights may be configured to be released and/or emptied once the oil containment recovery dome 100 reaches the ground surface beneath the body of water.

To minimize the potential of a negative environmental impact from such release, materials used to fabricate the weights and/or placed inside of the weights may be indigenous to the region where the oil containment recovery dome 100 is being used. An example of one such indigenous material is sand or seawater.

Alternatively, the weights may be left in attachment with the oil containment recovery dome 100 to assist in retaining the oil containment recovery dome 100 in a stationary position with respect to the oil well.

Figure 4:
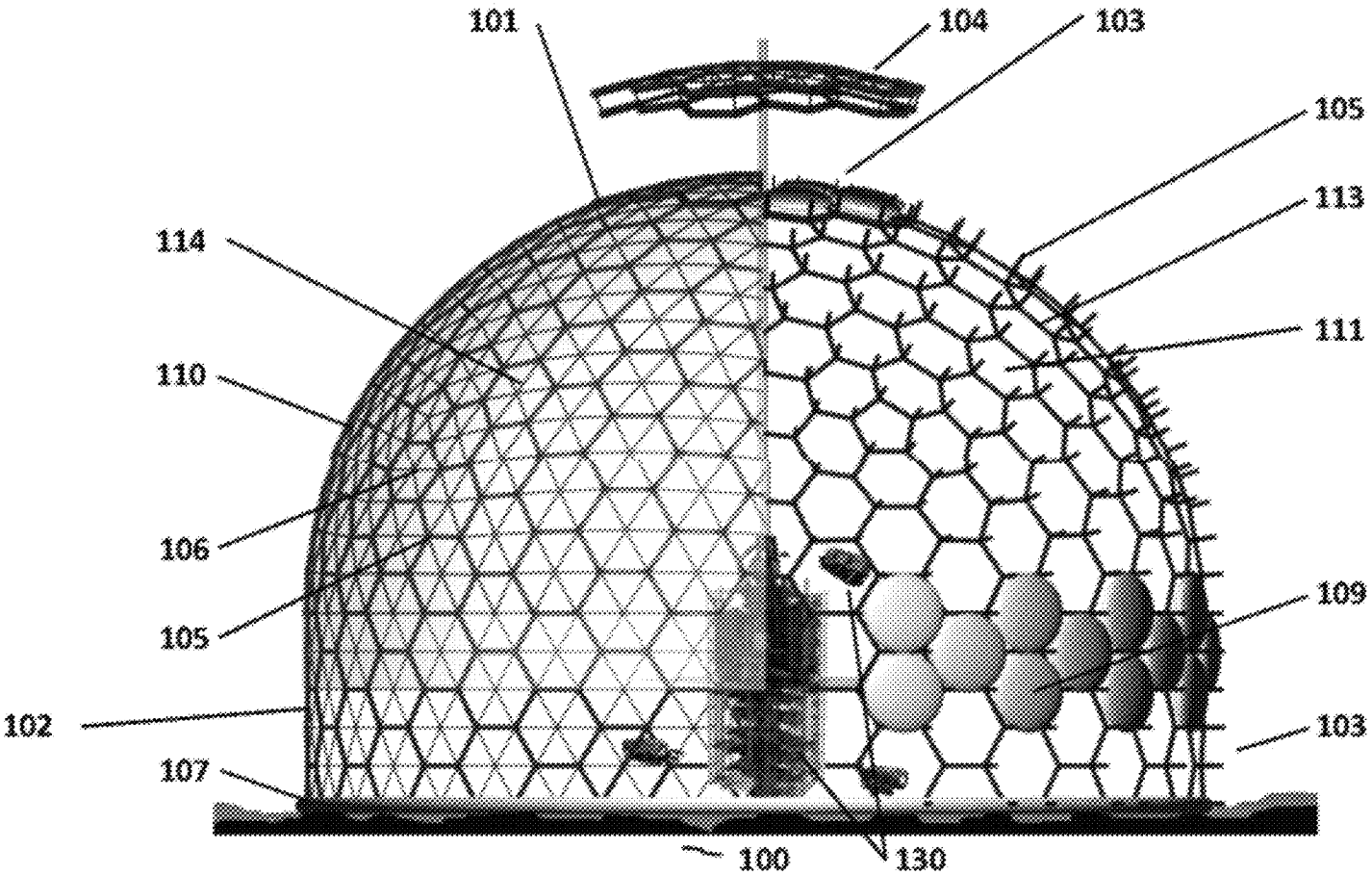
FIG. 4 is a vertical section view of a double resonated dome showing connectors, structure, bladders and other elements in conjunction with the oil containment recovery dome of FIGS. 1 and 2.
Figure 18:
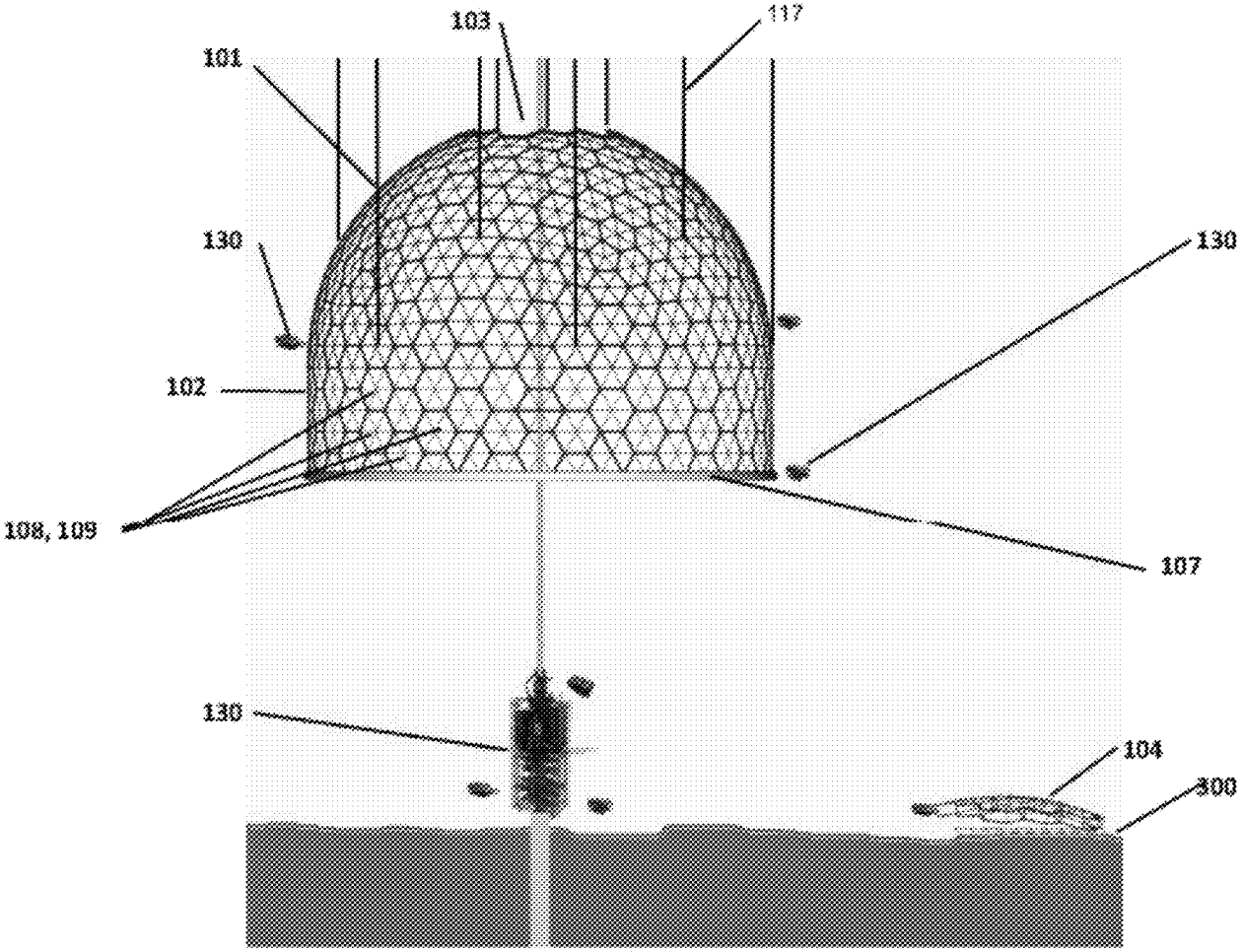
FIG. 18 is a profile view an oil containment recovery dome of FIGS. 2 and 4 being lowered by cables through a body of water towards a ground surface located beneath the body of water and showing a mooring position of an alternate removable cap on a platform illustrated in FIGS. 21 and 22.

Once the oil containment recovery dome 100 is positioned in a desired location, the equipment used to drill the oil well is then lowered from the surface of the body of water until the equipment extends through the oil containment recovery dome 100 and into the ground surface inside of the oil containment recovery dome 100, as illustrated in FIGS. 4, 18 and 19.

Next, the cap section 104 may be opened by either split opened or lowered onto the oil containment recovery dome 100, as illustrated in FIGS. 4, 19, 20, 26*a*, 26*b* and 26*c*. A variety of techniques may be used to attach the cap section 104 to the other portions of the oil containment recovery dome 100.

Figure 27B:
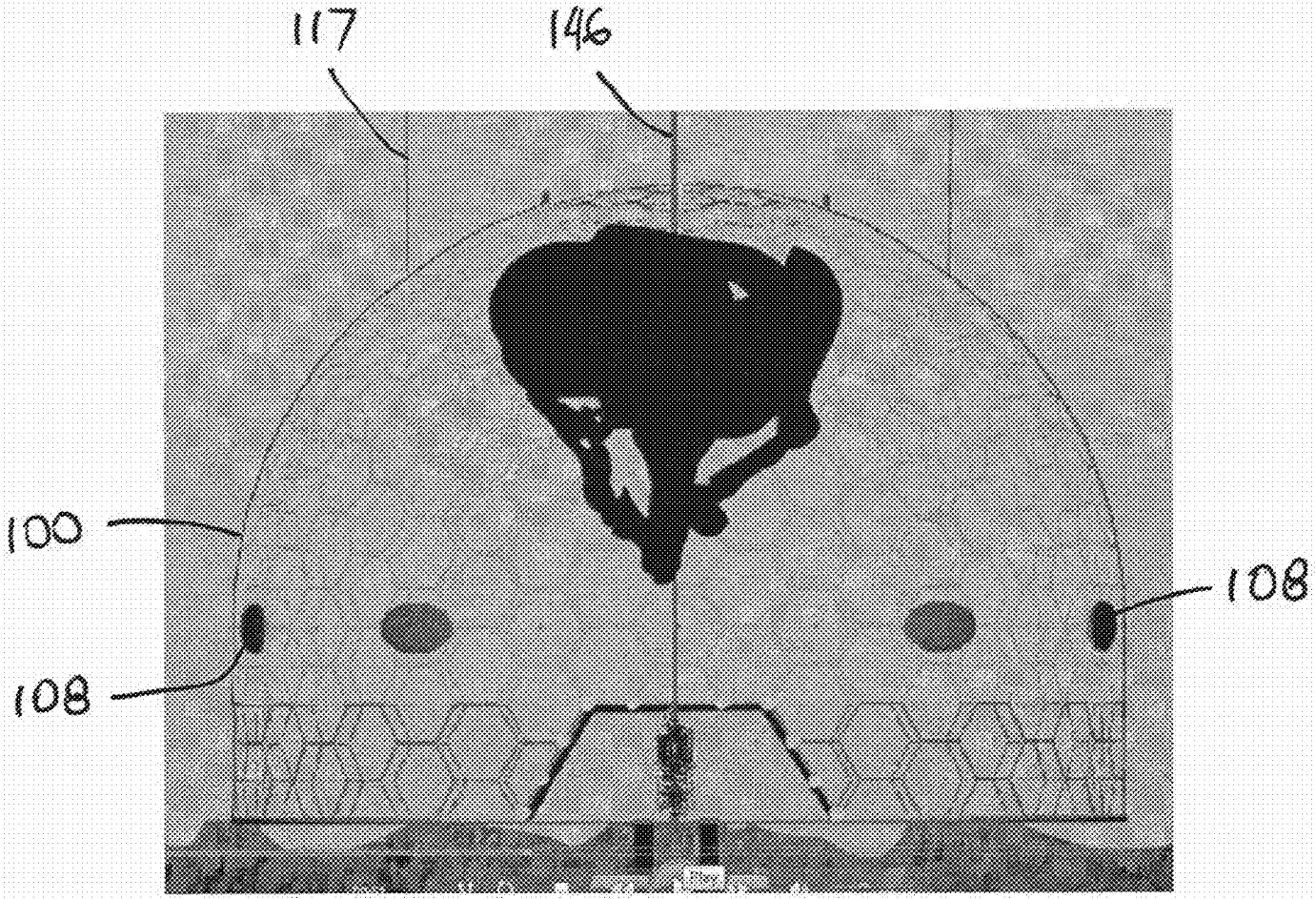

After installation, the oil containment recovery dome 100 may be in a substantially closed configuration. If an oil leak develops within the oil containment recovery dome 100, as illustrated in FIGS. 27*a* and 27*b*, the oil containment recovery dome 100 will substantially encapsulate the oil and gas leak.

Such encapsulation enables the leaked oil/gas to be recovered such as by extending a conduit 146 as a feed line into the interior of the oil containment recovery dome 100 through the first and second attachment assembly 105 and 106. The oil containment recovery dome 100 thereby minimizes the escape of oil and gas thereby minimizes the potential of negative environmental impact from the escaped oil.

In certain configurations, it is possible to contain, hold and then withdraw sufficient oil that leaks into the oil containment recovery dome 100 so that the oil is substantially contained within the oil containment recovery dome 100 until it is possible to stop the oil well from leaking. In other configurations, it may be desirable to employ additional techniques to control the rate at which the oil is leaking and/or prevent the oil from escaping from the oil containment recovery dome 100.

This process may be accomplished by selective use of the first attachment assembly 105 and the second attachment assembly 106 connected to recovery oil or gas feeder conduits and transferring recovered materials to surface equipment. Monitoring equipment may be inserted into select first attachment assembly 105 and second attachment assembly 106 to assist in locating the best attachment locations and types for the recovery equipment to be used for any given recovery condition.

An example of one such suitable technique that may be used in conjunction with the oil containment recovery dome 100 is to generate a heat-arc method proximate to where the oil and/or gas is leaking from the well. The method may be generated using equipment that is similar to the equipment used in conjunction with precautionary methane gas procedures from conduit 116 supplied, attachment assembly nodes 105 and 106.

A methane prevention arc may cause the oil and/or gas to change into a form that is more manageable and/or is less likely to cause environmental damage. For example, the arc may sufficiently warm methane gas that leaks from the well to prevent methane crystallization. The oil containment recovery dome 100 allows such space accommodation within the double resonated dome through conduit supplied attachment assembly nodes for such equipment.

In another configuration, the oil containment recovery dome 100 is adapted for installation and use after the oil drilling equipment is already in place. Such an application can be done either before or after oil and/or gas is leaking from the oil well.

Figure 28:
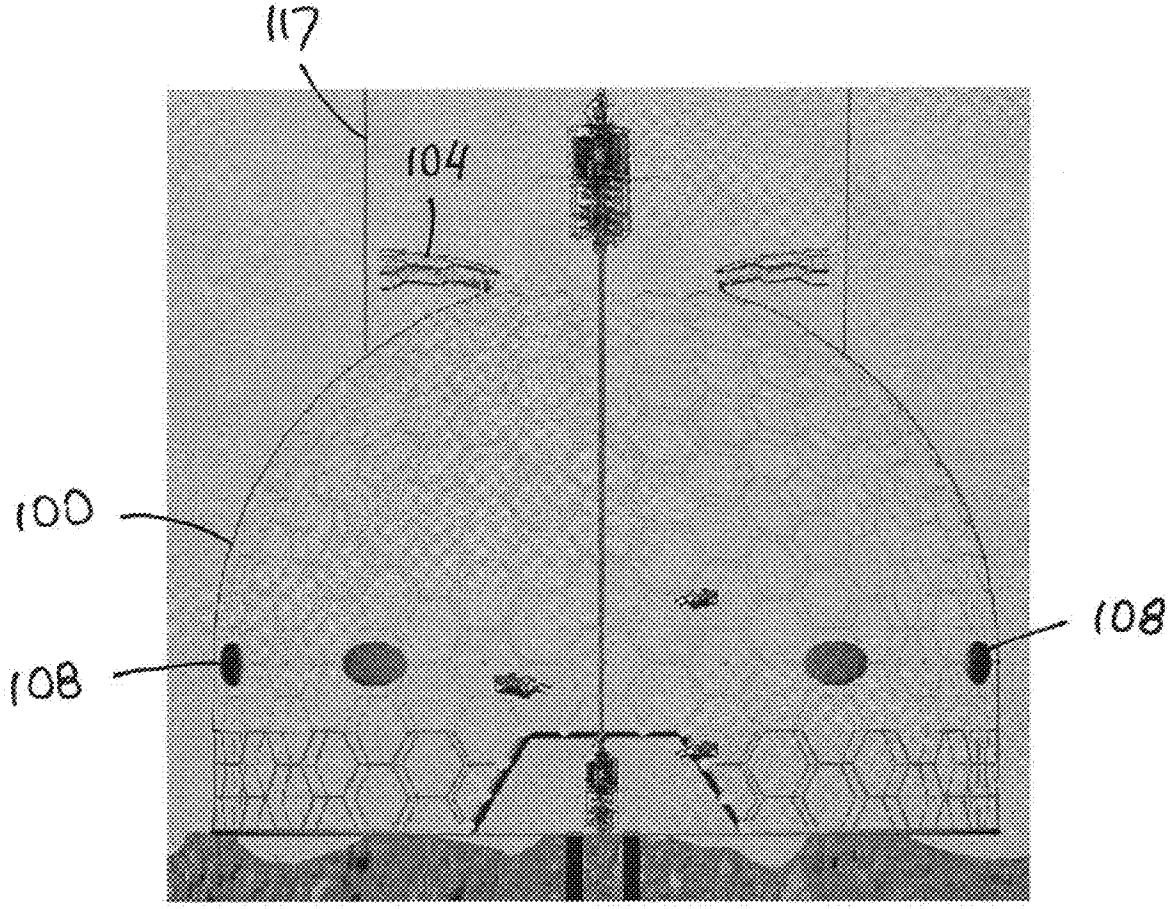
FIG. 28 is a side view of the cap in an open configuration enabling standard oil well equipment to access well as part of the oil containment recovery system.
Figure 29:
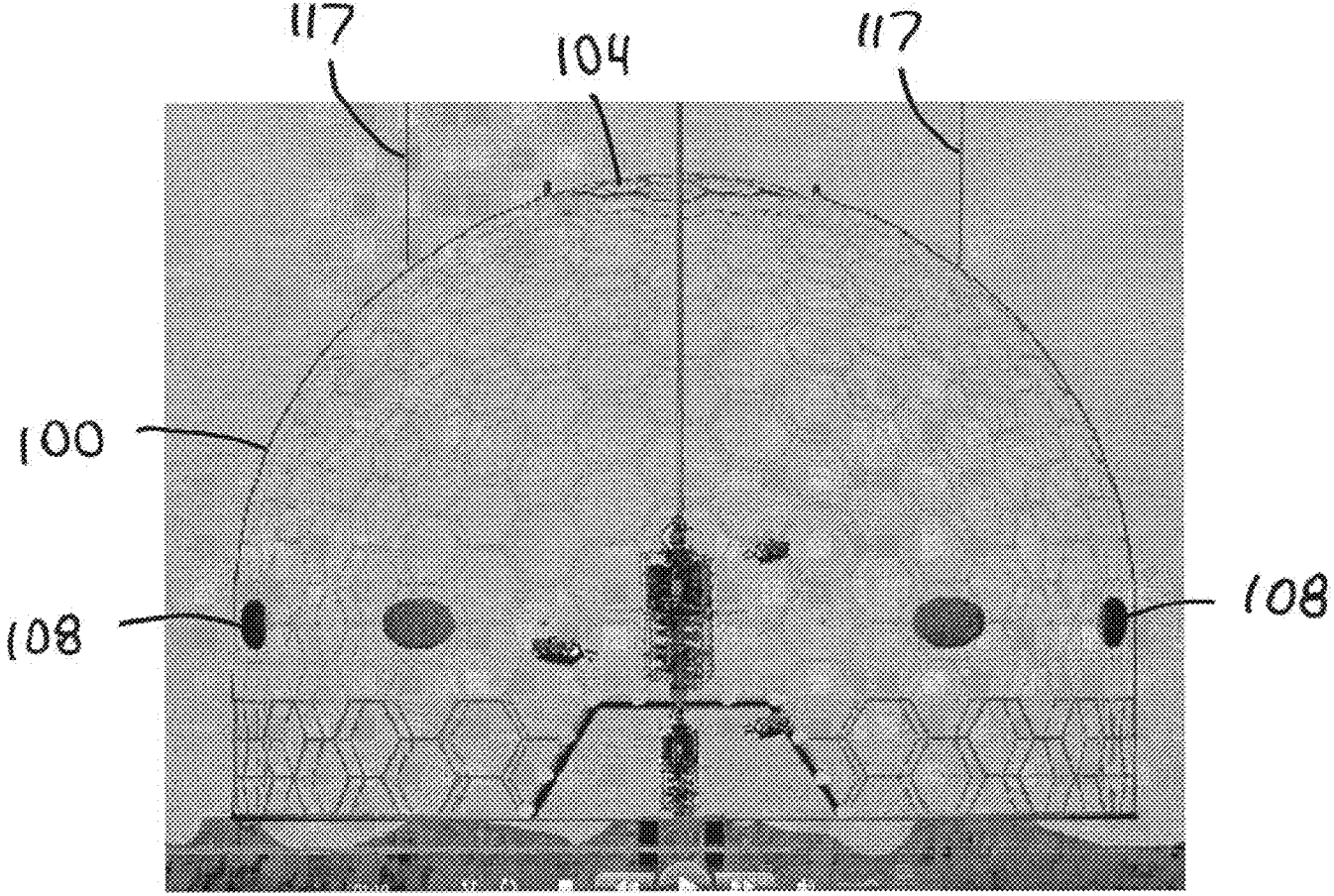
FIG. 29 is a side view of the cap portion in a closed configuration after the oil well equipment used in conjunction with the well has been moved into the oil containment recovery system.

To accommodate placement after the oil drilling equipment is in place, the oil containment recovery dome 100 may include at least one movable section that creates an opening so that the oil drill equipment and or lines extending from the oil drilling equipment can pass through such as illustrated in FIGS. 28 and 29.

In one such configuration, the upper sphere section 101 of the oil containment recovery dome 100 includes a plurality of cap sections 104 that are pivotally attached to each other. When the cap sections 104 are pivoted to an open configuration, an enlarged opening is thereby defined. When the cap sections 104 are pivoted to a closed configuration, a relatively small opening with riser boots 112 may be defined through which lines extending from the oil drilling equipment can pass.

Depending on the configuration of the cap sections 104, a pivoting axis may be oriented in a variety of configurations, examples of which include horizontal and vertical. The pivot hardware may attach to the first attachment assembly 105 as well as be used as temporary mooring.

As an alternative to pivotally attaching the cap sections 104, it is possible to fabricate the cap sections 104 separate from each other and then attach the cap sections 104 using a fastening system. The fastening system should permit operation such as by a remotely operable vehicle (ROV).

The oil containment recovery dome 100 has a shape that generally conforms to at least a portion of a sphere. By increasing the portion of the sphere, the volume of the oil containment recovery dome 100 may be increased. In certain embodiments, the oil containment recovery dome 100 may be about ¾ of a sphere.

The oil containment recovery dome 100 should be sufficiently large to encompass the various types of equipment that could be used for drilling the oil wells. The oil containment recovery dome 100 could also be used to position and/or support a flow-through sub-sea chemical injector that is used in conjunction with the oil well.

Connection assemblies may be attached to the first attachment assembly 105 FIGS. 5, 7, 9, 10 in an upper portion of the oil containment recovery dome 100 to accommodate lines that extend between the oil-drilling platform positioned on the water surface and the oil wells. A closure mechanism (not shown) may be provided to seal off the lines and thereby restrict the ability of the oil that leaks from the oil well from escaping from the oil containment recovery dome 100.

At least one of the outer skin dome assembly 110 and the inner skin dome assembly 111 may have a buoyancy/ballast bridging ring 107, which has a configuration that is similar to the embodiment discussed with respect to FIGS. 1-10. The lower portion may be adjusted to account for variations on the orientation and shape of the ground surface on which the oil containment recovery dome is placed. A variety of techniques may be used to facilitate such adjustability. It is also possible to fabricate the lower portion to be self-leveling.

To reduce the potential of the oil containment recovery dome 100 moving with respect to the oil well drilling equipment after installation; it is possible to use a mounting mechanism that extends between the lower portion and the seabed. An example of one such suitable mounting mechanism is a plurality of mooring anchors 115 alone or in conjunction with a plurality of moors.

To increase the reliability of the oil containment recovery dome 100; it should be fabricated with minimal mechanical parts and in certain embodiments, no mechanical parts.

As with the other forms of transport it may be necessary to increase buoyancy or stabilize with ballast for transport to instillation site. Increase buoyancy or stabilize with ballast can be accomplished by filling buoyancy/ballast tanks 108 buoyancy/ballast tank bladders 109 and buoyancy/ballast bridging ring 107 with appropriate amounts of buoyancy/ballast materials.

Figure 16:
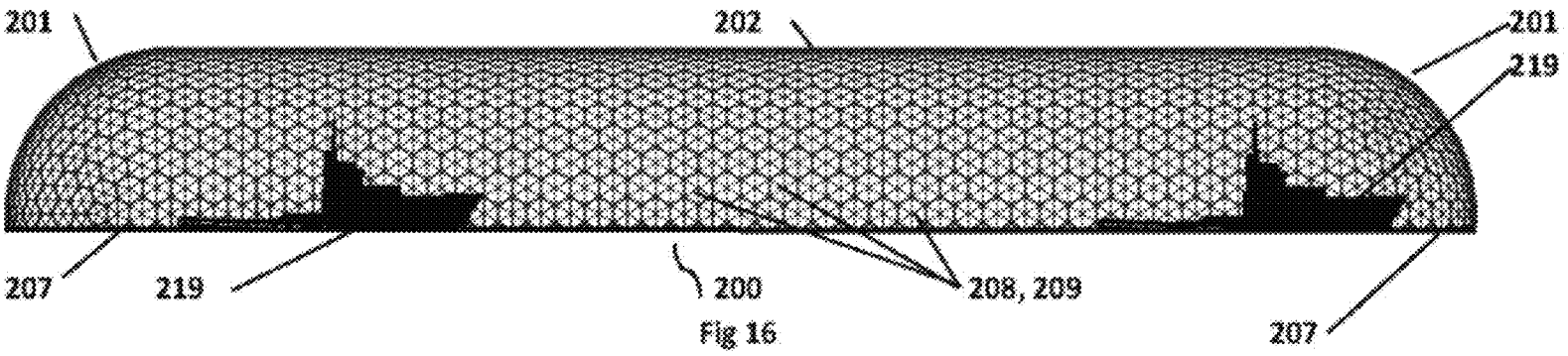
FIG. 16 is a profile view of an expanded oil containment recovery dome of FIG. 9 being transported to spill site by sea tugs.

It is also possible to fabricate the oil containment recovery dome 100 with a floatation device (not shown) attached thereto. In certain configurations, there floatation device is mounted along a lower surface of the oil containment recovery dome 100. When the floatation device is activated, the oil containment recovery dome 100 may be moved through the water using a tow vessel such as a tugboat as illustrated in FIG. 16.

Once the oil containment recovery dome 100 arrives at the location where it is intended to be used, the floatation device may be deactivated to cause the oil containment recovery dome 100 to sink into the water. The deactivation may be accomplished at a rate that is sufficiently slow so that the descent through the water is done in a controlled manner to minimize the potential of damage to the oil containment recovery dome 100.

When use of the oil containment recovery dome 100 at a particular location is completed, the floatation device may be activated to cause the oil containment recovery dome 100 to raise to the surface of the water so that the oil containment recovery dome 100 can be moved to another use location or to a storage location.

Because of the challenges associated with humans directly viewing the oil containment recovery dome 100, monitoring instruments may be used in conjunction with the oil containment recovery dome 100. Examples of the monitoring instruments include cameras, acoustic Doppler profilers, pulsed illuminator and transponders. This equipment may be mounted on attachment assemblies 105 or adjacent to the oil containment recovery dome 100.

While it is generally preferable for the oil containment recovery dome 100 to be slowly lowered from the surface of the water to the ground beneath the water; it is possible that the oil containment recovery dome 100 may experience a rapid descent toward the ground beneath the water.

At least one line may extend between the oil containment recovery dome 100 and the crane or other device used to lower the oil containment recovery dome 100 to the ground beneath the water. If the line breaks or if the crane begins rolling out the line too quickly, the oil containment recovery dome 100 may be permitted to descent too quickly.

Rapid contact of the ground beneath the water by the oil containment recovery dome 100 could damage the oil containment recovery dome 100. Such damage could impact the structural integrity of the oil containment recovery dome 100.

In certain embodiments, the oil containment recovery dome 100 may include a select number of deployable buoyancy/ballast tank bladders 109 as illustrated in FIG. 7. A select number of deployable buoyancy/ballast tank bladders 109 may be positioned proximate within a select number of buoyancy/ballast tanks 108 of the outer skin dome assembly 110 and the inner skin dome assembly 111 so that when the buoyancy/ballast tank bladders 109 is inflated, the buoyancy/ballast tank bladders substantially fills a region between the connectors.

While the description is provided herein as being an buoyancy/ballast tank bladders 109, a person of skill in the art would appreciate that this component could be broadly described as a restrainer bag that includes an outer enclosure in which a material is introduced to cause the outer enclosure to substantially fill the region between the connectors.

One of the buoyancy/ballast tank bladders 109 may be positioned proximate to every one of the connectors on at least one of the outer skin dome assembly 110 and the inner skin dome assembly 111. In other embodiments, the buoyancy/ballast tank bladders 109 may be positioned in a spaced-apart configuration on the oil containment recovery dome 100.

When it is sensed that the oil containment recovery dome 100 is descending more quickly than desired, the at least one buoyancy/ballast tank bladders 109 may be deployed so that the buoyancy/ballast tank bladders 109 extends substantially between at least one connector on the outer skin dome assembly 110 and at least one connector on the inner skin dome assembly 111.

In certain embodiments, the deployment of the buoyancy/ballast tank bladders 109 is controlled by a manual device that is linked to the buoyancy/ballast tank bladders 109 such as by a wired or wireless connection. In another embodiment, the buoyancy/ballast tank bladders 109 may have a sensor that causes the buoyancy/ballast tank bladders 109 to automatically deploy if it is determined that the pressure change monitored by the sensor is greater than a selected amount, which is indicative of the oil containment recovery dome 100 experiencing a potentially dangerous fall.

The pressure exerted by the at least one buoyancy/ballast tank bladders 109 should be sufficiently large so that the connector on the outer skin dome assembly 110 resists movement with respect to the connector on the inner skin dome assembly 111. However, the pressure exerted by the at least one buoyancy/ballast tank bladders 109 should not be too large such that the connector on the outer skin dome assembly 110 is forced away from the connector on the inner skin dome assembly 111. Such a movement could cause damage to the oil containment recovery dome 100. The buoyancy relief may be accomplished through the same inflation first attachment assembly 106.

It is also possible to mount at least one buoyancy/ballast tank bladders 109 on an outer surface and/or a lower surface of the oil containment recovery dome 100. The at least one buoyancy/ballast tank bladders 109 could thereby protect the oil containment recovery dome 100 from damage caused by contact with the ground beneath the water.

Because it is difficult to predict which side of the oil containment recovery dome 100 will make contact with the ground surface beneath the water, the buoyancy/ballast tank bladders 108 may be positioned at various locations on the outer surface and the lower surface of the oil containment recovery dome 100.

The at least one buoyancy/ballast tank bladders 109 may be formed having a variety of sizes using the concepts of the invention such that the buoyancy/ballast tank bladders 108 have sufficient strength to resist damage to the oil containment recovery dome 100. A factor that may be relevant to the size of the buoyancy/ballast tank bladders 109 is the weight of the oil containment recovery dome 100.

The buoyancy/ballast tank bladders 109 may be formed with a diameter that is approximately the same as the diameter of the oil containment recovery dome 100. In other embodiments, a plurality of buoyancy/ballast tank bladders 109 are attached together to provide a diameter that is approximately the same as the diameter of the oil containment recovery dome 100.

The buoyancy/ballast tank bladders 109 may be fabricated to rapidly expand when activated. The force utilized to expand the buoyancy/ballast tank bladders 109 may be sufficiently large to compensate for the pressures typically experienced in the region where it is desired to install the oil containment recovery dome 100.

Inflation of the buoyancy/ballast tank bladders 109 may be accomplished using a variety of techniques. Examples of potentially suitable techniques for inflating the buoyancy/ballast tank bladders 109 used in conjunction with the oil containment recovery dome 100 are techniques used in conjunction with inflating buoyancy/ballast tank bladders 109 used on automobiles.

The buoyancy/ballast tank bladders 109 may also be configured to provide additional strength to the oil containment recovery dome 100 so that the oil containment recovery dome 100 is better able to withstand damage caused by objects dropping onto the oil containment recovery dome 100. An example of one such object that could drop onto the oil containment recovery dome 100 is the oil-drilling rig or a component thereof.

Figure 10:
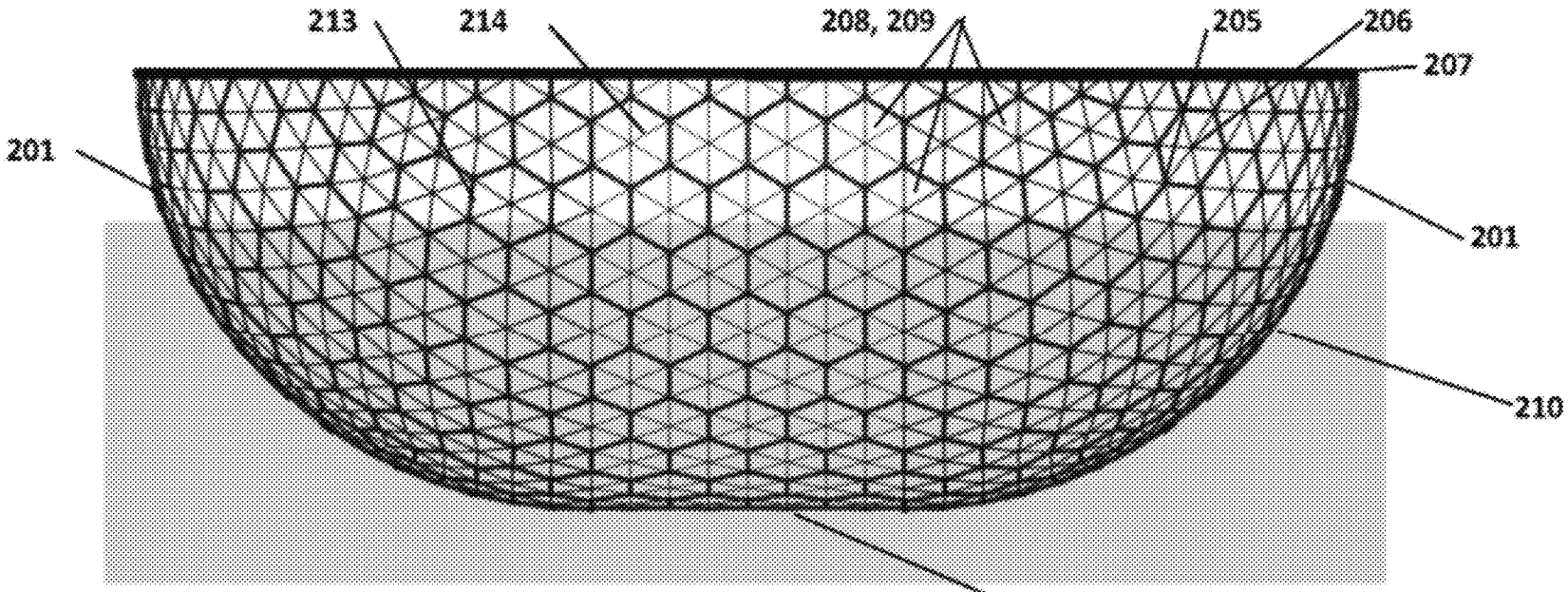
FIG. 10 is a profile view identifying elements of the elongated oil containment recovery dome of FIG. 9 while floating in a body of water.
Figure 11:
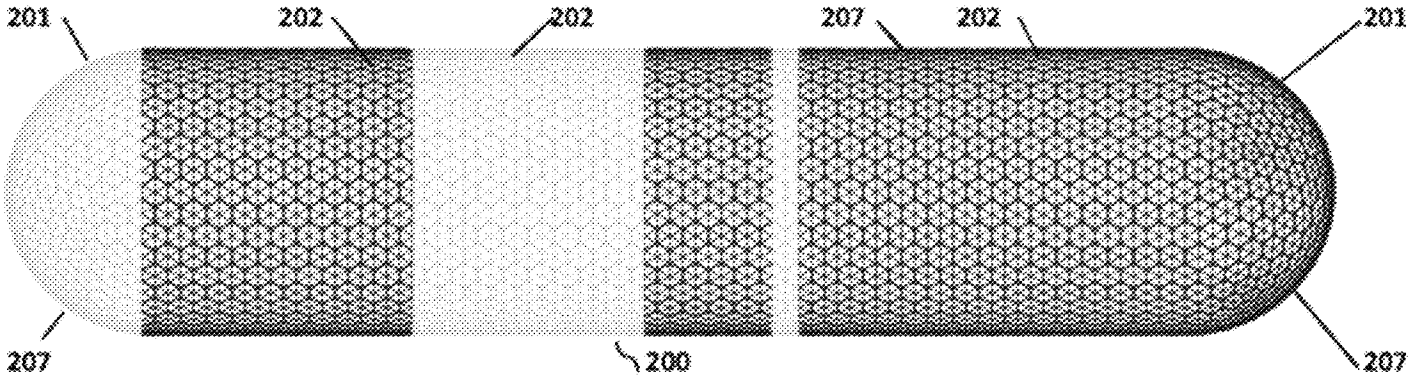
FIG. 11 is an elongated plan view of the oil containment recovery dome of FIG. 9.

In another embodiment, which is illustrated in FIG. 11, the oil containment recovery dome 200 includes an outer sphere section 201 and cylinder section 202. Two sphere sections 201 and a modular bay cylinder section 202 are attached to and separate the two sphere sections 201 FIG. 9. The oil containment recovery dome 200 may be one or two half-sphere sections 201 attached to one or two half-cylinder sections 202 illustrated in FIGS. 9 and 10.

All embodiments and configurations for oil containment recovery dome 100 also be applied to oil containment recovery dome 200 as illustrated in FIGS. 9, 10, 11, 15, 16, 17, 30 and 31 where the last two digits of the reference number are the same.

Figure 9:
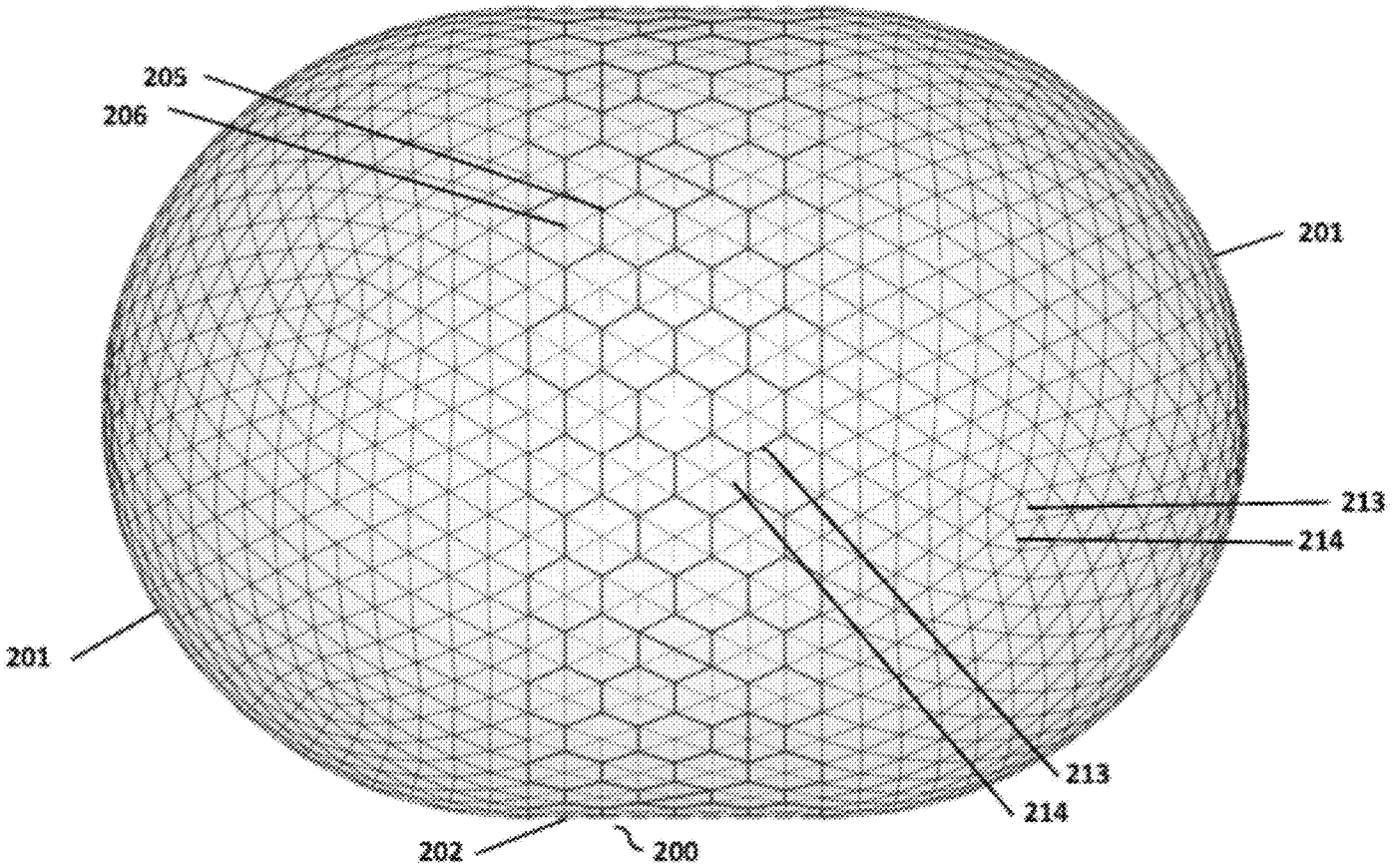
FIG. 9 is a plan view an elongated oil containment recovery dome of FIG. 1, with its vertical axis rotated to a horizontal position.

Oil containment recovery dome 200 is virtually the same as oil containment recovery dome 100 only in that it is generally oriented in the horizontal FIG. 9 instead of the vertical FIG. 2.

Due to the horizontal configuration of the oil containment recovery dome 200 modular expansion cylinder sections 202 may be needed as in FIG. 11. These sections are treated the same as described for the oil containment recovery dome 100.

Also due to the horizontal configuration of the oil containment recovery dome 200, buoyancy/ballast bridging ring 207 may need to be elongated to accommodate the necessary added cylinder sections 202 as illustrated in FIG. 11.

Figure 17:
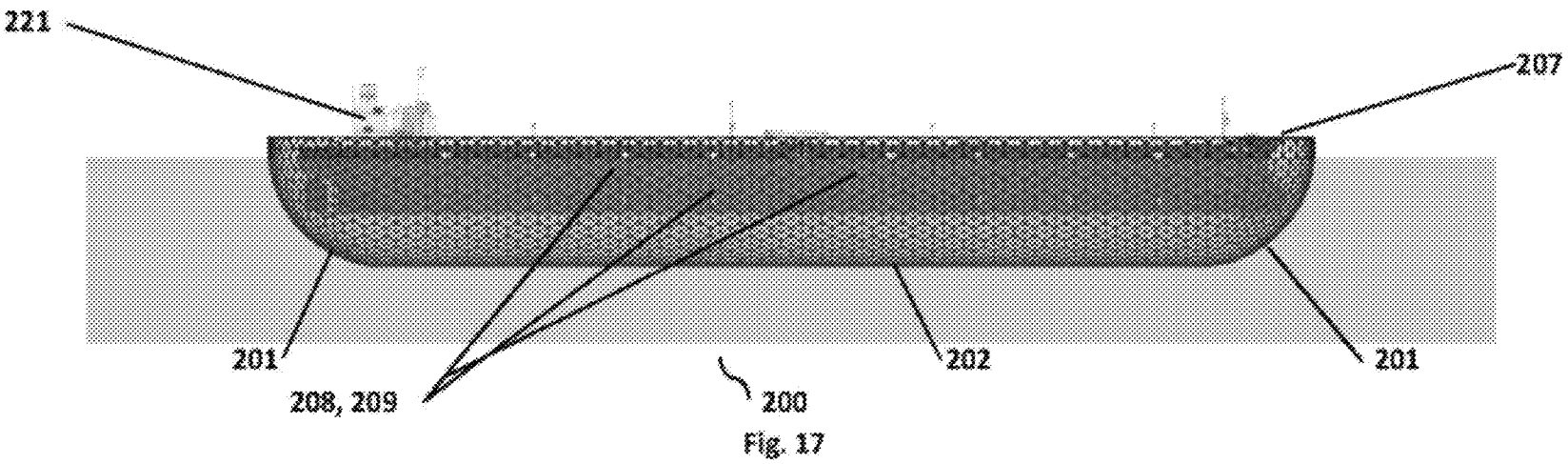
FIG. 17 is a profile view of oil containment recovery dome of FIG. 9 at recovery spill site in place around spill tanker vessel.
Figure 30:
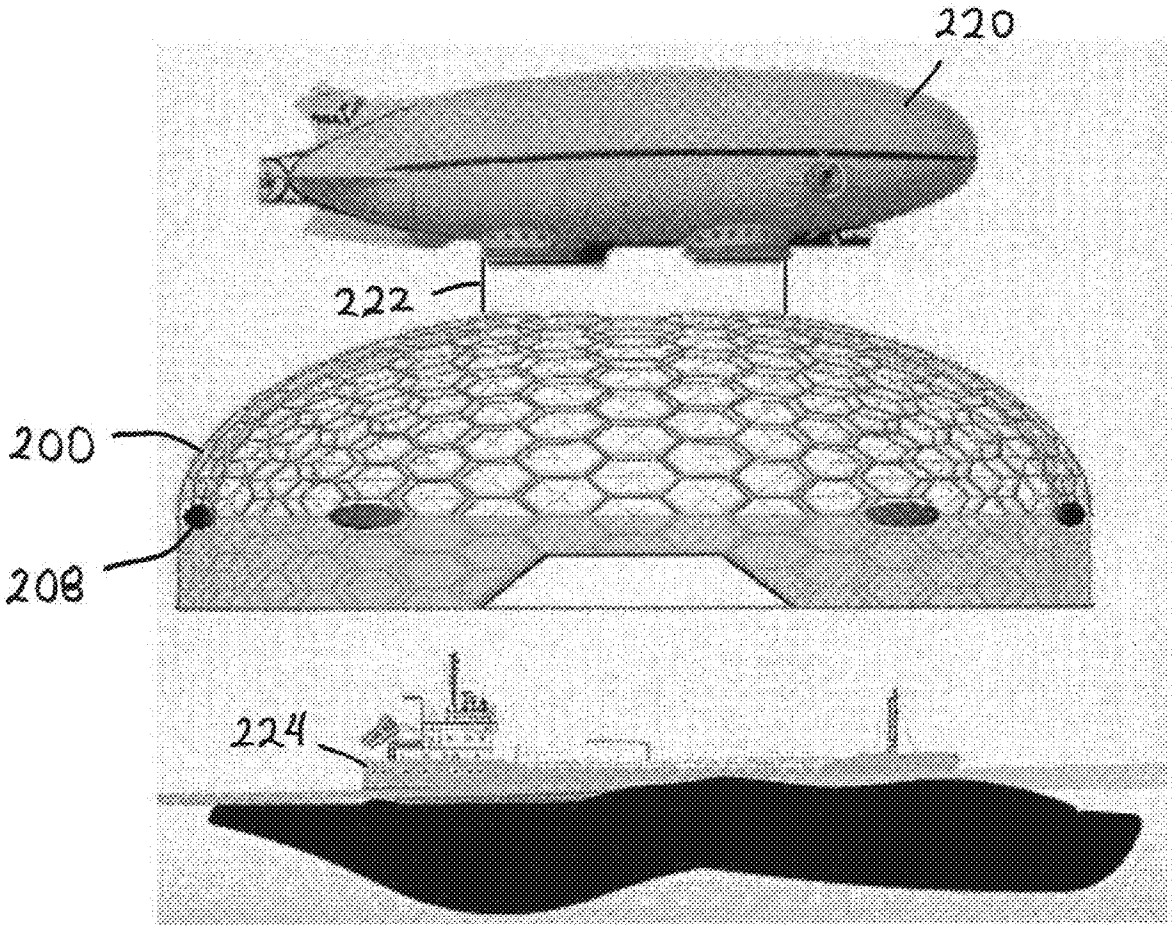
FIG. 30 is a side view of an alternative configuration of the oil containment recovery system utilizing a dirigible-blimp.
Figure 31:
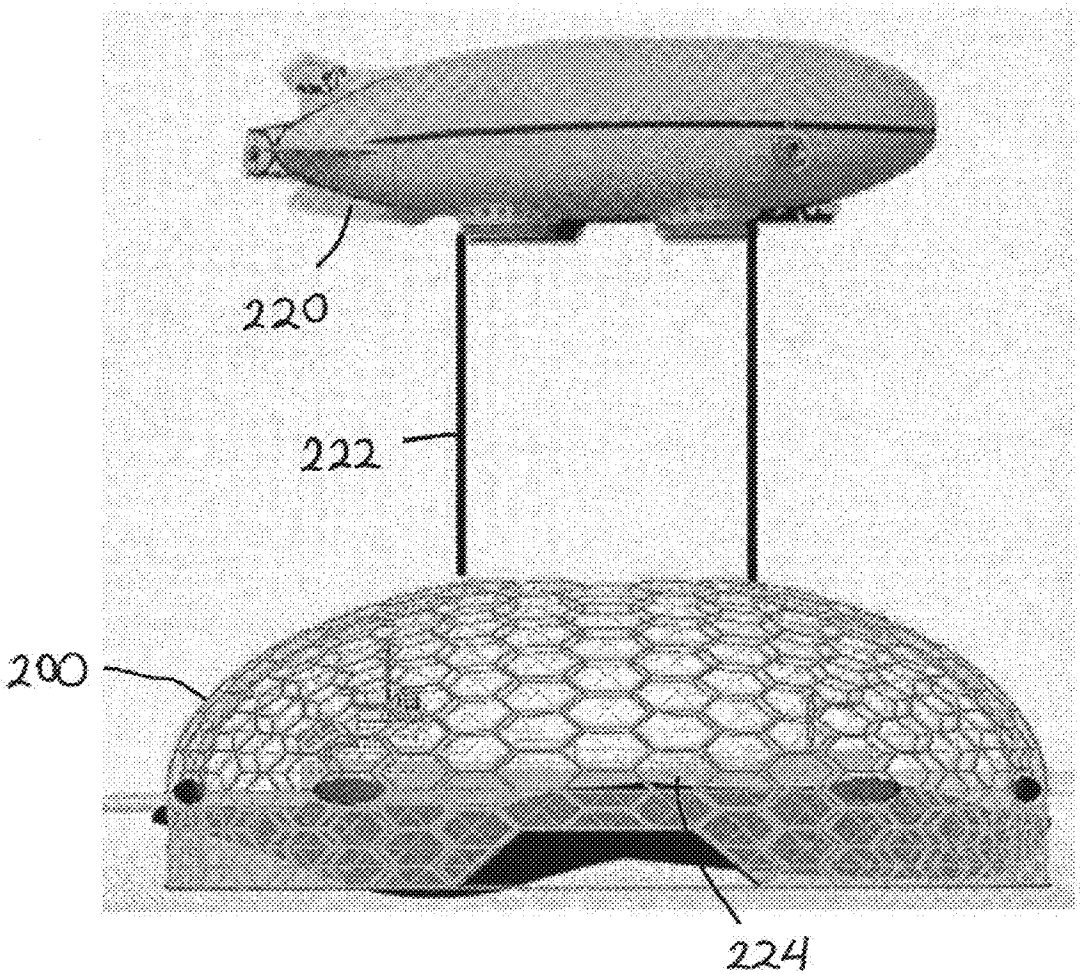
FIG. 31 is a side view of the oil containment recovery system being lowered over a vessel that is leaking oil into a body of water.

Another embodiment of oil containment recovery dome 200 allows for a horizontal separation enabling the oil containment recovery dome 200 to float as a boat and encapsulate a disable or damaged ship or large surface oil spill as illustrated in FIGS. 17, 30, and 31. It may be necessary to activate the buoyancy/ballast bridging ring 207, buoyancy/ballast tank 208, and buoyancy/ballast bladder system 209 for proper floatation Transport and installation of the oil containment recovery dome 200 may be accomplished in the same manner described for the oil containment recovery dome 100.

Figures 21, 22:
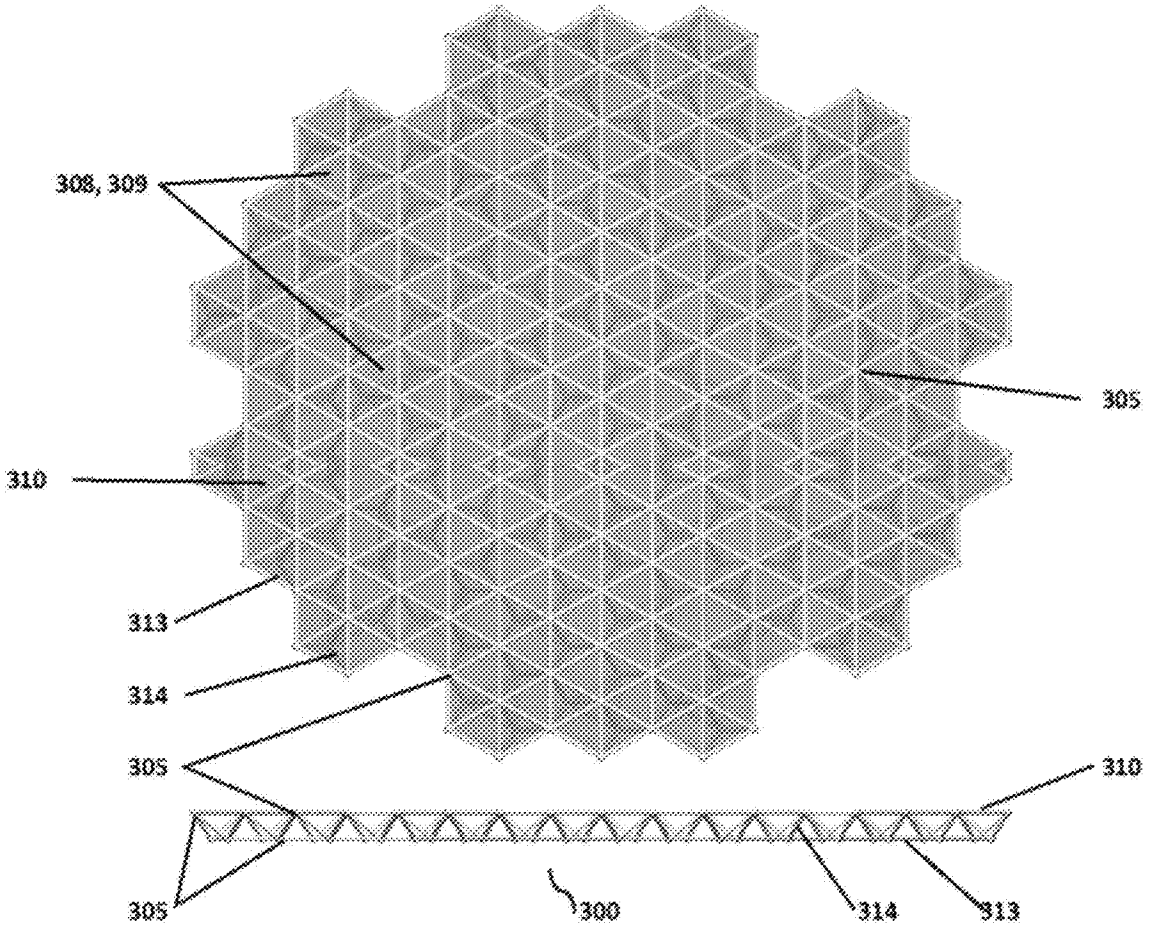
FIG. 21 is a plan view of a support platform that may be used with the base dome assembles of FIGS. 1, 4 and 8 in the alternative configuration of the oil containment recovery dome, it may also be used for staging and mooring.
FIG. 22 is a profile view of the support platform of FIG. 21.

Another embodiment of the invention relates to an oil containment recovery dome as illustrated at 300 in FIGS. 21 and 22 relates to a space truss and staging platform 300. Such a configuration may facilitate the use of the oil containment recovery dome 300 on ground surfaces that are not substantially flat or which are not oriented substantially horizontal.

Structural beams 313 are connected using structural connector 305 laid out in a triangular grid in two horizontal paralleled plains. To the same structural connector 305, which is the same as 106 and 206 of the oil containment recovery domes 100 and 200, is used throughout to connect both top and bottom horizontal planes together using structural beams 314.

A decking 310 may be added at appropriate locations as a covering, a staging surface, buoyancy/ballast tank 308 enclosure, buoyancy/ballast bladder 309 enclosure.

If buoyancy/ballast tank 308 and/or buoyancy/ballast bladder 309 are installed, they may be used in the same way as the similar structures in the oil containment recovery domes 100 and 200.

The staging platform 300 may also be used as an anchoring device for dome 100 by adding ballast to the buoyancy/ballast tank 308, and or buoyancy/ballast bladder 309 in a sufficient amount two counter the buoyancy lift from enclosed oil being recovered or other uplift forces imposed on the oil containment recovery dome 100 or staging platform 300.

Another anchoring method is to apply mooring anchors 315 alone or in conjunction with ballast in a sufficient amount to counter the buoyancy lift from enclosed oil being recovered or other uplift forces imposed on the oil containment recovery dome 100 or staging platform 300.

Another embodiment of the invention is illustrated in FIGS. 30 and 31. In this embodiment, the oil containment recovery dome is formed with a length and a width that is larger than a ship from which oil is leaking The oil containment recovery dome 200 may be transported to an area where it is needed using a variety of devices such as a dirigible 220. The oil containment recovery dome may be connected to the dirigible using at least one cable 222.

When the oil containment recovery dome 200 is proximate to the ship 224 from which oil is leaking, the oil containment recovery dome 200 is lowered over the ship 224 such that a lower edge of the oil containment recovery dome 200 extends into water to a depth that is lower than the depth at which the oil is anticipated to be located, as illustrated in FIGS. 30 and 31.

A plurality of buoyancy bladders 208 may be positioned around the oil containment recovery dome 200 may retain the oil containment recovery dome 200 at a consistent depth so that objects that extend from an upper surface of the ship 224 do not contact the oil containment recovery dome 200.

The oil containment recovery dome 200 thereby contains the oil there within. The contained oil may then be collected from the contained region. While it is illustrated that the oil containment recovery dome 200 remains connected to the dirigible 220, the buoyancy bladders 208 enable the oil containment recovery dome 200 to be disconnected from the dirigible 220 during the oil recovery process.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An oil containment recovery dome for use in conjunction with an oil or gas well, wherein the oil containment recovery dome comprises:

an upper containment portion having an enclosure defined therein that is adapted to receive equipment used in conjunction with the oil or gas well and to retain therein oil or gas that escapes from the well, wherein at least part of the upper containment portion has a geodesic shape, wherein the upper containment portion comprises an inner dome section and an outer dome section, wherein the inner dome section is attached to the outer dome section and wherein the inner dome section and the outer dome section each have a frame assembly that comprises:

a plurality of elongated elements; and a plurality of connectors that interconnect the plurality of elongated elements to form an array;

an inner cover material that extends over at least a portion of the upper containment portion, wherein the inner cover material is substantially impermeable to at least one of oil and gas;

at least one conduit attached to the upper containment portion for removing oil or gas from the enclosure; and at least one bladder attached to the upper containment portion.

2. The oil containment recovery dome of claim 1, and further comprising:

an opening formed in the upper containment portion; and a cap section that is attachable to the upper containment portion to substantially close the opening, wherein the cap section is movable between an open configuration and a closed configuration.

3. The oil containment recovery dome of claim 1, and further comprising a lower containment portion that is attached to a lower edge of the upper containment portion, wherein at least part of the lower containment portion has an adjustable cylinder height.

4. The oil containment recovery dome of claim 1, and further comprising an outer cover material that extends over at least a portion of the upper containment portion, wherein the outer cover material protects the upper containment portion from damage.

5. The oil containment recovery dome of claim 1, and further comprising a buoyancy or ballast material that is placed in the at least one bladder, wherein the buoyancy or ballast material has a density that is not less than a density of water or is less than the density of water.

6. The oil containment recovery dome of claim 1, and further comprising at least one anchor that is capable of engaging the upper containment portion to retain the upper containment portion in a stationary position with respect to the oil or gas well.

7. The oil containment recovery dome of claim 1, and further comprising monitoring equipment mounted with respect to the oil containment recovery dome, wherein the monitoring equipment is capable of evaluating pressure, temperature, flow rate, composition or combinations thereof.

8. The oil containment recovery dome of claim 1, and further comprising protection means associated therewith to discourage animate objects from contacting the upper containment portion.

9. A method of containing and recovering oil or gas that leaks from a well that is located beneath a surface of a body of water, wherein the method comprises:

constructing an oil containment recovery dome comprising an upper containment portion, an inner cover material and at least one conduit, wherein the upper containment portion has an enclosure defined therein that is adapted to receive equipment used in conjunction with a well and to retain therein oil or gas that escapes from the well, wherein the upper containment portion comprises an inner dome section and an outer dome section, wherein the inner dome section is attached to the outer dome section, wherein the inner dome section and the outer dome section each have a frame assembly that comprises a plurality of elongated elements and a plurality of connectors that interconnect the plurality of elongated elements to form an array, wherein the inner cover material extends over at least a portion of the user containment wherein the inner cover material is substantially impermeable to at least one of oil and gas and wherein the at least one conduit is attached to the upper containment portion for removing oil or gas from the enclosure;

transporting the oil containment recovery dome to a location where a well is located; and positioning the oil containment recovery dome over the well.

10. The oil containment and recovery method of claim 9, and further comprising:

accidentally discharging oil or gas from the well into the water; and substantially containing the oil or gas within the oil containment recovery dome.

11. The oil containment and recovery method of claim 9, wherein transporting the oil containment recovery dome comprises:

moving the oil containment recovery dome along a path that is proximate to or above a surface of the body of water in which the well is located; and moving the oil containment recovery dome towards a surface beneath the body of water in which the well is formed.

12. The oil containment and recovery method of claim 9, and further comprising:

providing at least one bladder on the oil containment recovery dome;

filling the at least one bladder with a first material that is less dense than water to maintain the oil containment recovery dome proximate an upper surface of the body of water; and filling the at least one bladder with a second material that is not less dense than water to maintain the oil containment recovery dome in a substantially stationary position with respect to the well.

13. The oil containment and recovery method of claim 9, and further comprising conveying the oil or gas from the oil containment recovery dome to a collection apparatus.

14. An oil containment and recovery system comprising:

an oil containment recovery dome comprising an upper containment portion, an inner cover material and at least one conduit, wherein the upper containment portion has an enclosure defined therein that is adapted to receive equipment used in conjunction with a well and to retain therein oil or gas that escapes from the well, wherein the upper containment portion comprises an inner dome section and an outer dome section, wherein the inner dome section is attached to the outer dome section, wherein the inner dome section and the outer dome section each have a frame assembly that comprises a plurality of elongated elements and a plurality of connectors that interconnect the plurality of elongated elements to form an array, wherein the inner cover material extends over at least a portion of the upper containment portion, wherein the inner cover material is substantially impermeable to at least one of oil and gas and wherein the at least one conduit is attached to the upper containment portion for removing oil or gas from the enclosure; and a transport vehicle that is capable of moving the oil containment recovery dome to a location where the oil containment recovery dome is used.

15. The oil containment and recovery system of claim 14, wherein the transport vehicle includes a system for moving the oil containment recovery dome with respect to the transport vehicle.

16. The oil containment and recovery system of claim 14, and further comprising:

an outer cover material that extends over at least a portion of the upper containment portion, wherein the outer cover material protects the upper containment portion from damage.

17. The oil containment and recovery system of claim 14, and further comprising:

an opening formed in the upper containment portion; and a cap section that is attachable to the upper containment portion to substantially close the opening, wherein the cap section is movable between an open configuration and a closed configuration.

18. The oil containment and recovery system of claim 14, and further comprising at least one anchor that is capable of engaging the upper containment portion to retain the upper containment portion in a stationary position with respect to a well.

* * * * *